US006938617B2

(12) United States Patent
Le et al.

(10) Patent No.: US 6,938,617 B2
(45) Date of Patent: Sep. 6, 2005

(54) OVEN ASSEMBLY WITH SLIDES

(75) Inventors: Baoloc Le, La Puente, CA (US); Quinn Chi, El Monte, CA (US); Klaus Dobberstein, Beselich (DE); Markus Geberzahn, Hadamar (DE)

(73) Assignee: Accuride International Inc., Santa Fe Springs, CA (US)

( * ) Notice: Subject to any disclaimer, the term of this patent is extended or adjusted under 35 U.S.C. 154(b) by 0 days.

(21) Appl. No.: 10/617,493

(22) Filed: Jul. 10, 2003

(65) Prior Publication Data

US 2004/0112371 A1 Jun. 17, 2004

Related U.S. Application Data

(60) Provisional application No. 60/395,204, filed on Jul. 10, 2002, and provisional application No. 60/407,102, filed on Aug. 29, 2002.

(51) Int. Cl.[7] ..... F24C 15/16

(52) U.S. Cl. ..... 126/339; 126/337 A; 126/273 R; 312/410; 312/334.1

(58) Field of Search ..... 126/339, 337 R, 126/337 A, 273 R, 19 R; 312/410, 273, 274, 334.1, 330.1; 211/181.1

(56) References Cited

U.S. PATENT DOCUMENTS

| | | | | |
|---|---|---|---|---|
| 1,896,307 A | | 2/1933 | Hatch | 126/337 R |
| 1,918,457 A | * | 7/1933 | Dowell | 248/239 |
| 2,033,859 A | | 3/1936 | Otte | 126/339 |
| 2,466,360 A | | 4/1949 | Bitney | 126/337 R |
| 2,899,255 A | | 8/1959 | Evans | |
| 4,651,713 A | | 3/1987 | Ondrasik, II | 126/339 |
| 6,148,813 A | | 11/2000 | Barnes et al. | 126/339 |
| 6,643,900 B2 | | 11/2003 | Jährling | |
| 6,789,861 B1 | | 9/2004 | Dobberstein | |
| 2001/0044992 A1 | | 11/2001 | Jahrling | |

FOREIGN PATENT DOCUMENTS

| | | | |
|---|---|---|---|
| EP | 1 158 185 A2 | | 11/2001 |
| EP | 1 158 185 A3 | | 7/2002 |
| FR | 2 266 110 | | 10/1975 |
| FR | 2 266 110 A | * | 10/1975 |
| WO | WO 01/30162 A1 | | 5/2001 |

OTHER PUBLICATIONS

International Search Report for International Application No. PCT/US03/22329 filed Jul. 10, 2003 (3 pages) mailed Jan. 2, 2004.

Office action mailed Sep. 15, 2004 for U.S. Appl. No. 10/651,488, filed Aug. 29, 2003 (9 pgs).

Amendment filed on Jan. 18, 2005 in U.S. Appl. No. 10/651,488, filed Aug. 29, 2003 (13 pgs).

Hettich International, "QUADRO The Ball Bearing Principle", Modern Woodworking, Feb. 2002 (p. 8).

U.S. Appl. No. 10/651,488, filed Aug. 29, 2003, entitled Oven Rack Assembly With Slide, Inventors: Baoloc Le, Quinn Chi; Klaus Dobberstein, Markus Geberzahn, including Specification and Claims (23 pgs); Informal Drawings (21 pgs).

International Search Report dated Feb. 18, 2004 for International Application No. PCT/US03/27026 filed Aug. 29, 2003, mailed Mar. 12, 2004 (4 pages).

IFW materials for US 6,789,861 BI (57 pgs).

* cited by examiner

*Primary Examiner*—Josiah C. Cocks
(74) *Attorney, Agent, or Firm*—Christie, Parker & Hale LLP

(57) ABSTRACT

An oven rack assembly including full extension slides. Full extension slides are mounted to an oven rack and oven rack frames or wire racks providing full extension of an oven rack from an oven enclosure. The rack frame is mounted to oven walls or the slides are coupled to wire racks along oven slide walls.

12 Claims, 35 Drawing Sheets

OVEN ASSEMBLY WITH SLIDES

CROSS REFERENCE TO RELATED APPLICATION

This application claims the benefit of U.S. Provisional Application No. 60/395,204, filed Jul. 10, 2002 and U.S. Provisional Application No. 60/407,102, filed Aug. 29, 2002 which are hereby incorporated by reference as if set forth in full herein.

BACKGROUND OF THE INVENTION

The present invention relates generally to ovens, and more particularly to extendable rack assemblies for ovens.

Ovens often have one or more racks generally within the oven. The racks are useful for the placing of cookware, food, and other items, within the oven. The racks place the cookware generally towards the middle of the oven, and keep the cookware away from heating elements and the like. In addition, ovens with multiple racks allow for placement of cookware on a variety of levels within the oven, thereby increasing the total volume of available cooking space.

The racks are often supported by ledges formed along the walls of the oven. The racks are then movable in and out of the oven on the ledges. This allows the racks to be removed from the oven for cleaning or for other purposes. Often, the racks may be partially removed from the oven so as to allow easier access to items placed on the racks.

Movement of the racks on the ledges, or through other friction mechanisms, may not always provide smooth and relatively effortless motion. Unconformities in the ledges or friction mechanisms may interfere with motion of a rack. Similarly, food or other items may become lodged in a rack pathway, increasing the difficulty in movement of the rack.

In addition, the racks often may not be extended very far from the oven, particularly when heavy items are placed on the rack. Since the racks must still be supported by the ledges of the oven, over extension of the rack may lead to disastrous results, with the rack and its contents dropping to perhaps the floor. Moreover, the items on the rack may be difficult to view or handle if the rack is partially in the oven. This increases the chances of burns occurring to users of the oven through contact with other racks or the side walls of the oven. Further, at times lateral stability of a rack, particularly when a rack is extended from the oven, may be important.

Moreover, in some environments it is useful to temporarily lock a rack in some predefined position, whether within or outside the oven. For example, in some instances it may be useful to temporarily lock a rack in an extended position while items are placed on the rack. Similarly, securely positioning the rack within the oven during cooking or otherwise may also be useful.

BRIEF SUMMARY OF THE INVENTION

The present invention provides an oven with an extendable rack. In one embodiment the rack is fully extendable from the oven. In one embodiment this is accomplished through the use of a full extension slide provided on a rack frame resting on ledges of the oven, with a rack coupled to the full extension slide. In one aspect, the invention provides an extendable oven rack assembly comprising an oven rack adapted for positioning in an oven cavity; two full extension slides, one each coupled to opposing margins of the oven rack, with the slides adapted for positioning approximate opposing side walls of the oven cavity and the slides providing extension of the oven rack from a position entirely within the oven cavity to a position outside the oven cavity.

Another aspect of the invention provides an extendable oven rack assembly comprising an oven rack adapted for positioning in an oven cavity; two full extension slides, one each coupled to opposing margins of the oven rack, opposing wire frames positioned approximate opposing margins of the oven rack, the wire frames containing vertically spaced cross-bars; a first bracket coupled to each slide, the first bracket including a channel receiving a single cross-bar of the wire frame; and a second bracket coupled to each slide, the second bracket including a channel and a ledge, the channel receiving the single bar and the ledge extending under the single bar.

Another aspect of the invention an oven comprising: an oven enclosure including sidewalls having ledges; an oven rack normally within the oven enclosure; full extension slides each with a first slide member coupled to the oven rack along opposing margins of the oven rack; and a rack frame coupled to a second slide member of each of the full extension slides, the rack frame resting on opposing ledges of the oven enclosure.

Another aspect of the invention provides an oven comprising an oven enclosure including sidewalls having ledges; an oven rack normally within the oven enclosure; full extension slides each with a first slide member coupled to the oven rack along opposing margins of the oven rack; opposing wire frames positioned approximate the side walls of the oven, the wire frames containing vertically spaced cross-bars, a first bracket coupled to each slide, the first bracket including a channel receiving a single cross-bar of the wire frame; and a second bracket coupled to each slide, the second bracket including a channel and a ledge, the channel receiving the single bar and the ledge extending under the single bar.

Another aspect of the invention provides a drawer slide assembly with mounting brackets adapted to mount to a cross-bar, comprising a first slide member; a second slide member extendably coupled to the first slide member; a first bracket coupled to the first slide member, the first bracket including a channel configured to receive a cross-bar to provide support for the drawer slide assembly in a first direction; a second bracket coupled to the first slide member, the second bracket including a channel and a ledge, the channel configured to receive the cross-bar to provide support for the drawer slide assembly in the first direction, and the ledge configured to contact the cross-bar when the cross-bar is received by the channel and to prevent motion of the drawer slide assembly about the ledge in a second direction opposite the first direction.

Another aspect of the invention provides an oven rack assembly comprising an oven rack; full extension slides comprising a first slide member and a second slide member extendably coupled by an intermediate slide member, each first slide member coupled to the oven rack along opposing margins of the oven rack; and a rack frame coupled to the second slide member of each of the full extension slides.

These and other aspects of the invention are more fully comprehended on review of the following in view of the accompanying figures.

DETAILED DESCRIPTION

Figure 1:
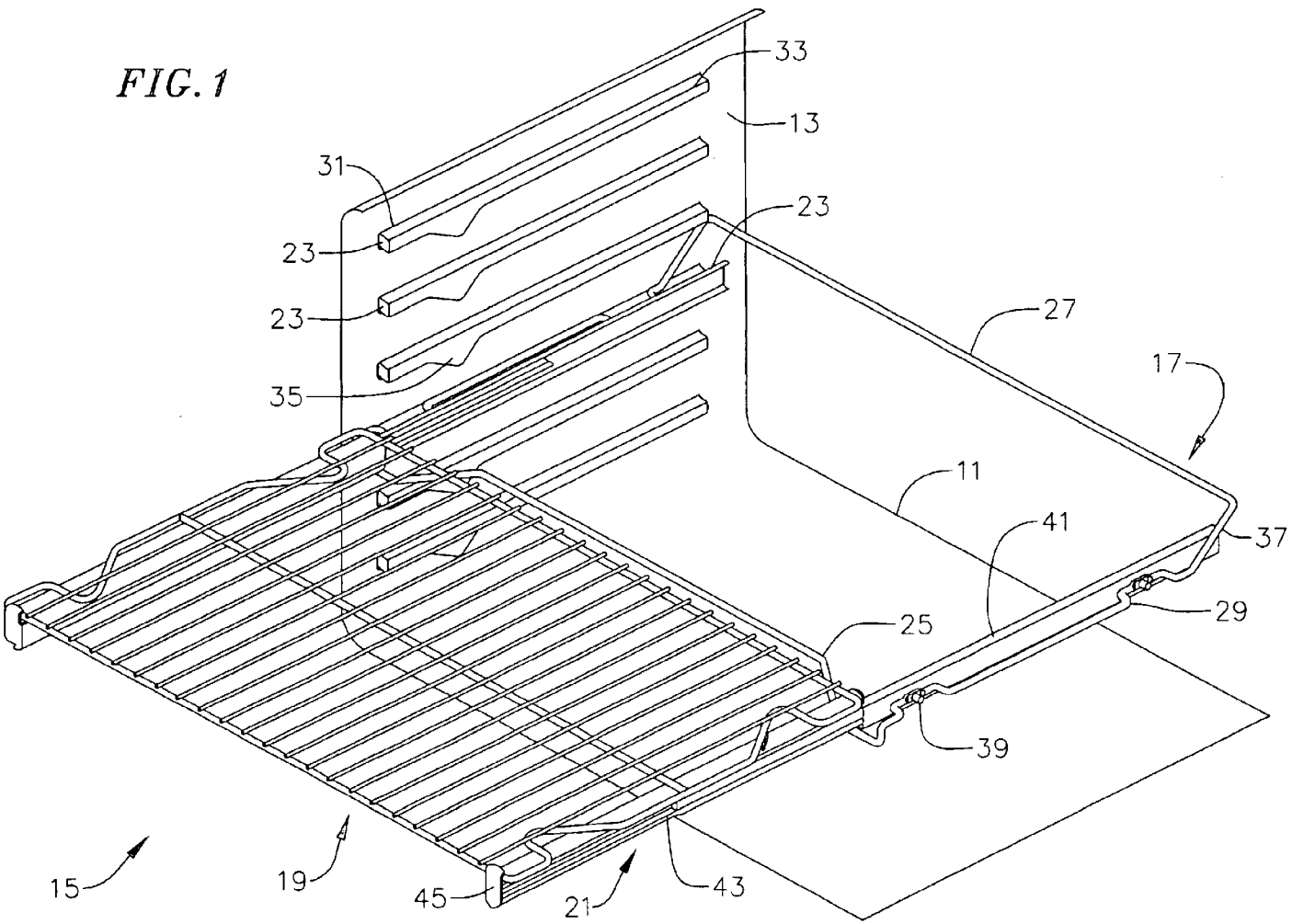
FIG. 1 illustrates a partial view of an oven with a rack assembly of the present invention.

FIG. 1 illustrates a partial view of an oven. As illustrated, the oven includes a base 11 and a side wall 13. Not specifically illustrated, but known to many, is a back wall of the oven, a roof of the oven, an opposing side wall opposing the side wall illustrated, and a door across the front of the oven. These elements of the oven are not specifically illustrated, although known, so as to allow further view of a rack assembly 15 used in the oven. The rack assembly includes a rack frame 17 supported within the oven, a rack 19 to support cookware, and extendable slides 21 interconnecting the rack and the rack frame. In use the rack frame remains seated within the oven, and the rack may be extended from the oven using the extendable slides.

In the oven of FIG. 1, the rack frame rests on ledges 23 on the oven sidewalls. The rack frame forms a substantially rectangular shape of tubular metal, with a front bar 25, a rear bar 27, and side bars 29 connecting the front and rear bars at their ends.

Figure 2:
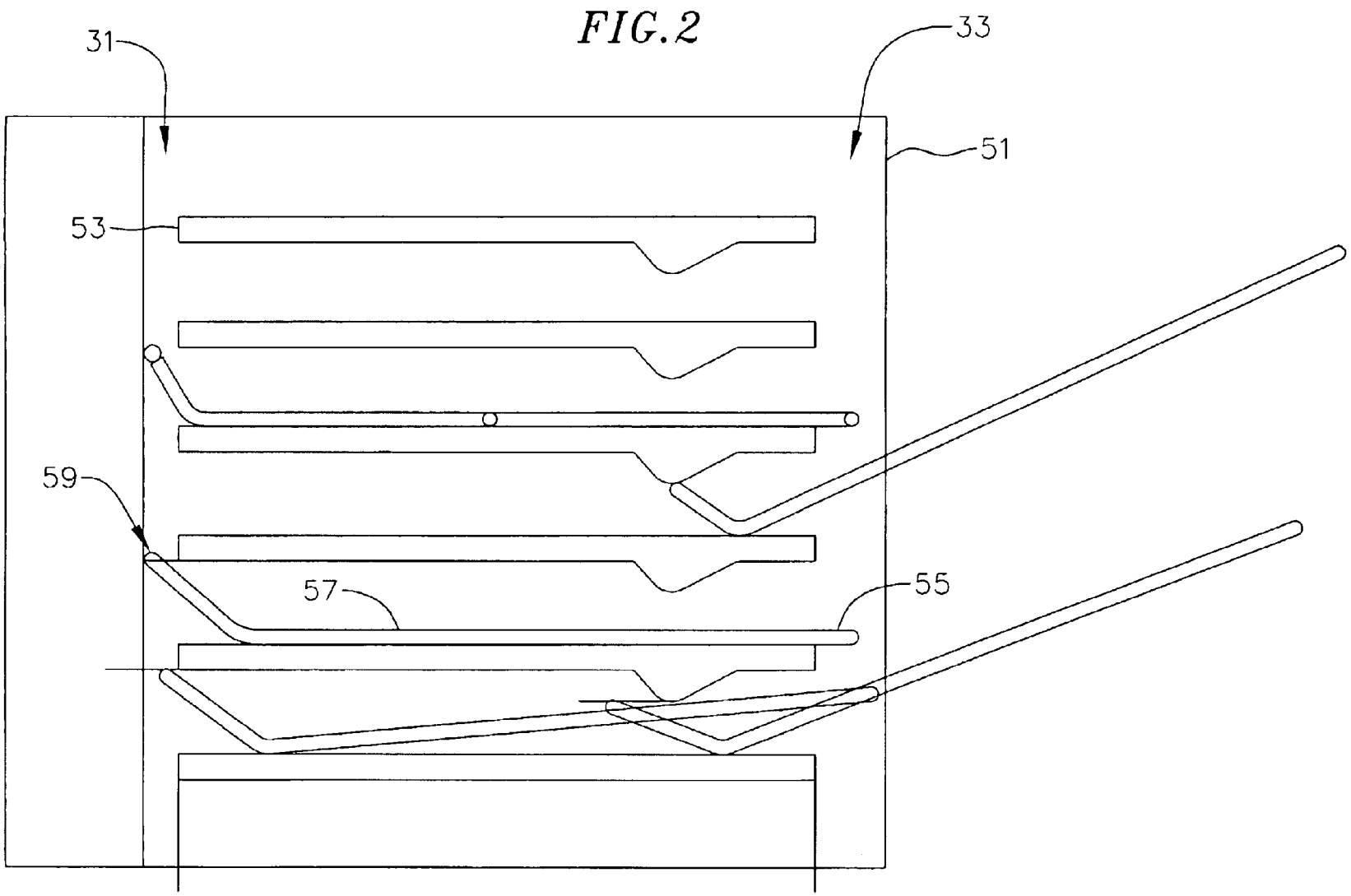
FIG. 2 illustrates a side view of an oven wall and rack frame resting on a ledge of the oven wall.

The side bars rest upon ledges formed on the side walls of the oven. In the oven of FIG. 2, twelve ledges are provided, with six ledges on the illustrated side wall and six ledges on the not shown opposing side wall. The corresponding ledges on the two sidewalls are at substantially the same height, with each of corresponding ledges providing a substantially flat surface which may support an object which extends from one side wall of the oven to the other. As illustrated, the ledges substantially cross the length of the oven, with gaps 31, 33, as may be seen in FIGS. 1 and 2, towards the front of the oven and towards the rear of the oven. The underside of each of the ledges also includes, towards the front of the ledges, a downward protrusion 35. The downward protrusion is used in some ovens so as to stop forward movement of a rack in the oven.

As illustrated in FIG. 1, a ramped portion 37 is formed along rear ends of the side bars of the rack frame. Thus, the rear bar of the rack frame is elevated somewhat with respect to the front bar of the rack frame when the side bars rest on the ledges. The rear bar is elevated an amount sufficient to have its forward movement obstructed by another ledge in the series of ledges on the oven side walls.

FIG. 2 more fully illustrates this aspect, and other aspects, of the rack frame and the ledges of the oven side wall. FIG. 2 is a side view illustrating an oven side wall 51, ledges on the oven side wall 53, and a rack frame 55. As illustrated, a first distance separates each ledge of the ledges of the side wall. Side bars 57 of the rack frame largely rest on the ledges. The side bars are angled upwards towards the rear of the side bars. The result is a rear bar 59 of the rack frame is in an elevated position. The side bars are angled sufficiently such that the rear bar of the rack frame is elevated at a greater amount than the distance separating the ledges. Thus, the rear bar may be suitably placed into the gap between the ledges and a rear wall of the oven such that forward motion of the rear bar is obstructed by a ledge. In the embodiment illustrated, the side bars are angled approximately 40 degrees from the horizontal.

In addition, the relative position of the ledges on the oven side wall and the rear bar of the rack frame serve to prevent undue angular motion of the rack assembly, particularly when the rack is extended from the oven and forms a lever arm with respect to the rack frame. Further, in the event of changes to oven cavity designs, modification of the rack frame design may be accomplished without necessarily significant changes to other components of the rack assembly.

Returning to FIG. 1, the side bars of the rack frame include a mounting feature 39 allowing mounting of the side bars to a web 41 of the drawer slide. In one embodiment the mounting feature is a hole placed through the side bars allowing a screw, a bolt, a rivet, or other mounting feature to be attached through the rack frame and into a web of a slide member. In other embodiments other mounting methods are used. As will be described in somewhat more detail, a flange can be welded or otherwise attached to the rack frame, such that the flange extends upwards of the rack frame and a slide member mounted to the flange.

Figure 3:
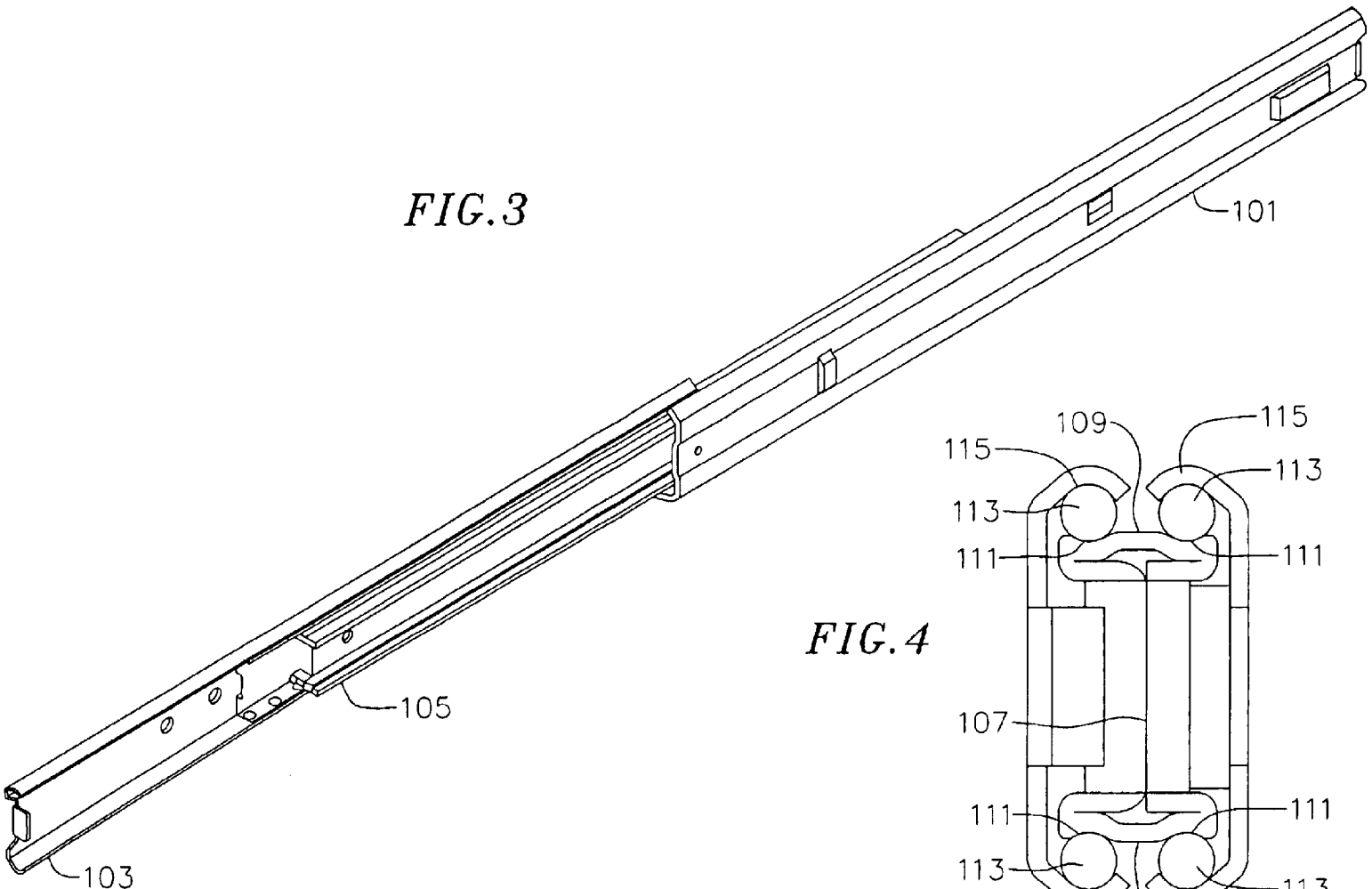
FIG. 3 is a perspective view of a side-by-side slide used in an embodiment of the rack assembly.
Figure 4:
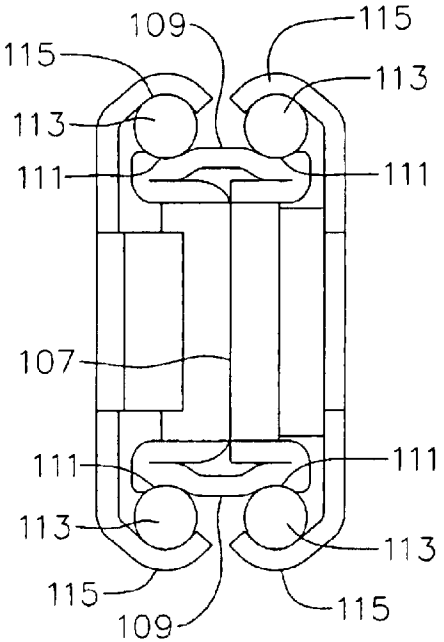
FIG. 4 is a cross-section of the side-by-side slide of FIG. 3.

FIG. 3 illustrates a perspective view of a full extension slide used in some embodiments of the invention. As illustrated, the slide of FIG. 4 is a side-by-side slide. The side-by-side slide, sometimes also called a parallel slide, often, and as illustrated, includes two outer members 101, 103 with generally C-shaped cross-sections, with the members arranged so that the C-shaped cross-sections oppose each other. Between the two generally C-shaped cross-sections is a somewhat I-shaped inner member 105. In operation, the outer members extend in opposing directions from the inner member, with the outer members and the inner member connected by way of bearings riding in bearing raceways.

FIG. 4 illustrates a cross-section of the slide of FIG. 3. As illustrated, the inner member is a substantially I-shaped member. The inner member may be formed, for example, by bonding two somewhat C-shaped members together along their webs. In the example illustrated in FIG. 4, however, the inner member is a roll formed I-shaped member. The I-shaped member includes a central web 107, with cross pieces 109 on the top and the bottom of the web. The cross pieces include bearing raceways 111 along either side of the web. Bearings 113 ride in the bearing raceways and rollably couple the inner member to the outer members. Thus, the outer members also include bearing raceways 115 formed along the length of webs of the outer members, with the bearings riding in the bearing raceways of the outer and inner members.

Returning to FIG. 1, and taking a first drawer slide as an example, the side edges of the rack frame are fixed to a web of a first outer member. Accordingly, the first outer member is fixed to the rack frame, with the rack frame within the oven. The inner member extends from the first outer member, and is illustrated as being extended from the first outer member towards the front of the oven. A second outer member extends from the inner member with the second outer member substantially fully out of the oven. Thus, as in the instant case, the term full extension when used with respected slide refers to the ability of a portion of the slide, namely a slide member, to extend substantially completely out of an enclosure.

A rack is coupled, in some embodiments by way of a mounting accessory discussed later, to the second outer member. Thus, the rack may be extended substantially out of the oven. Moreover, the rack is stably supported by the slides.

Figure 5:
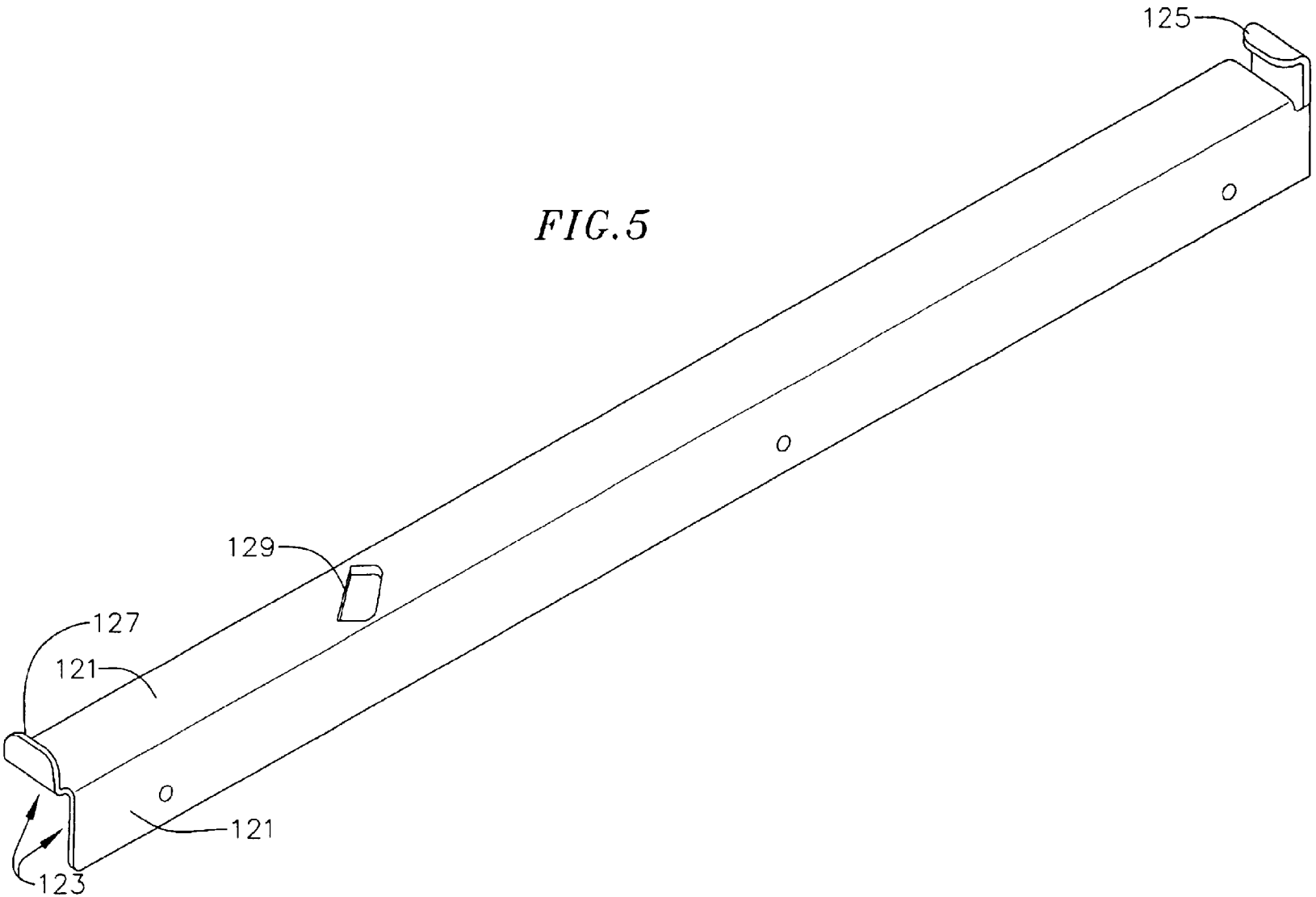
FIG. 5 illustrates a slide accessory useful with the slide of FIG. 3.

As illustrated in FIG. 1, the rack includes side bars 43 which are removably mounted to an accessory 45 on the drawer slide. FIG. 5 illustrates an embodiment of the accessory. As illustrated in FIG. 5, the accessory is an elongated L-bracket. The L-bracket includes two outer surfaces 121 on the outside of the L and two inner surfaces 123 on the inside of the L. One of the outer surfaces is adapted to be mated to a web of a slide member. In one embodiment, and as illustrated, a side of the L-bracket includes holes adapted to receive fasteners and the like for attachment of the bracket to the web of the slide member.

As the web of the slide member is in operation substantially vertical, the side of the L-bracket attached to the slide member may be viewed as the vertical component of the L-bracket. The other side of the L-bracket may therefore be viewed as a horizontal component of the L-bracket. The outer side of the horizontal component of the L-bracket includes retention features for retaining the rack in position. As illustrated in FIG. 5, the retention features include a hook 125 at one edge of the side and an abutment 127 at the opposing edge of the side. Thus, a forward bar of the rack may be slid under the hook, with the rear bar of the rack placed against the abutment, as may also be seen in FIG. 1.

To further stabilize the rack in use, the upper edge of a horizontal component also includes an angled abutment 129. The angled abutment is adapted to contact an angled surface of the rack so as to prevent side to side motion of the rack. As the abutment is angled, the abutment also serves to help prevent forward and rearward motion of the bracket as well.

The use of the L-bracket also serves to shroud parts of the slide. For example, and as illustrated in FIG. 1, the top of the L-bracket substantially crosses the width of the slide. Accordingly, during extension and retraction of the slide the portions of the slide moving with respect to one another are shielded from accidental insertion of debris or fingers or other items which might impact the ability of the slide to extend or retract. Further, when the slide is fully retracted the operational features of the slide are protected from spattering of material cooking in the oven.

Figure 5A:
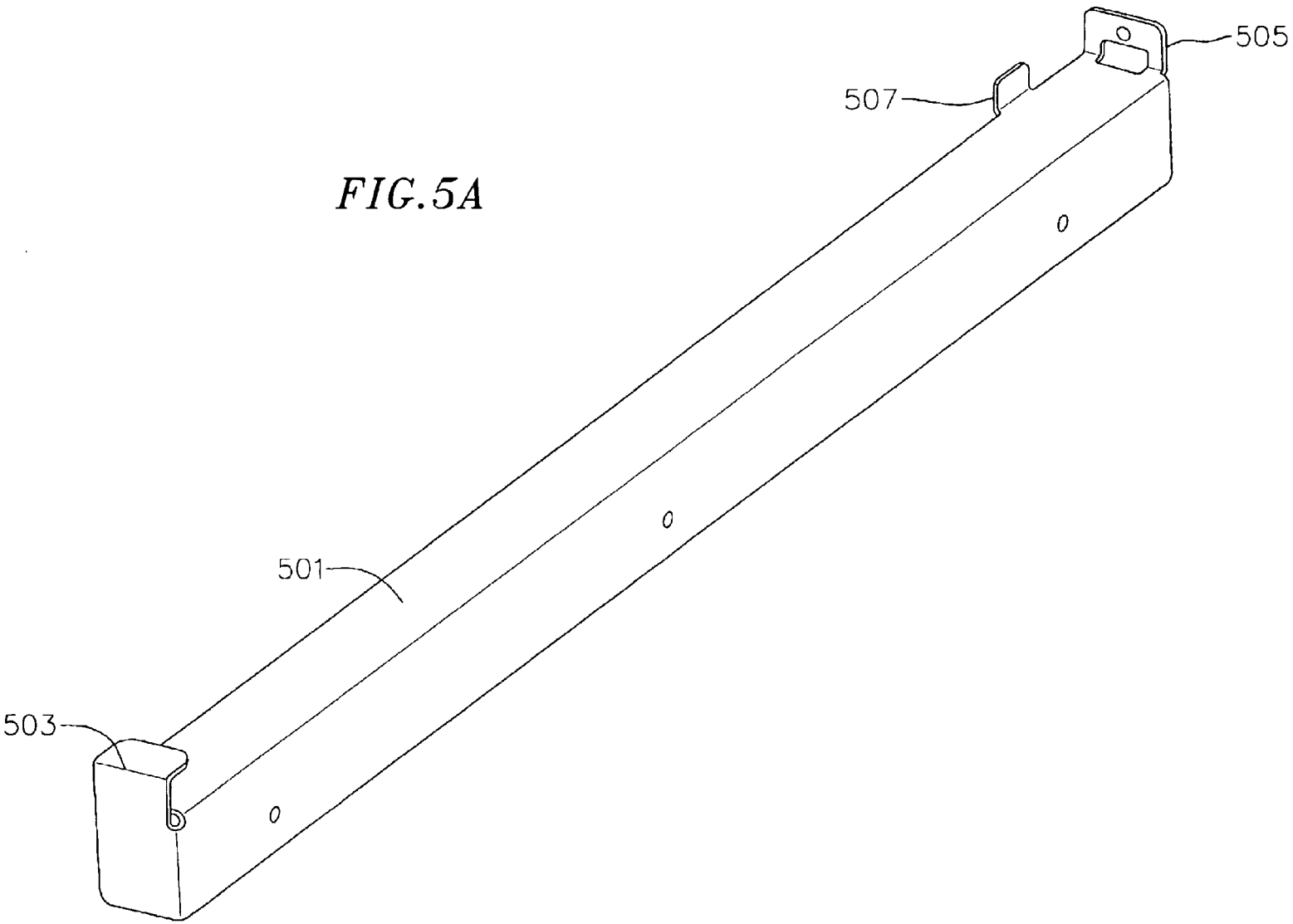
FIG. 5*a* illustrates a further slide accessory useful with the slide of FIG. 3.

FIG. 5*a* illustrates a further elongated L-bracket to which a rack may be removably mounted. The accessory of FIG. 5*a* is similar to the accessory of FIG. 5. As with the accessory of FIG. 5, an outer side of a horizontal component 501 of the L-bracket includes retention features for retaining the rack in position. As illustrated in FIG. 5*a* the retention features include a hook 503 at one edge of the side and an abutment 505 at the opposing edge of the side. A forward, or alternately rear, bar of the rack may be slid under the hook, with the rear, or alternately forward, bar of the rack placed against the abutment. To further stabilize the rack in use, the upper edge of the horizontal component also includes a side wall 507 portion. The side wall portion is adapted to be placed against the side wall of the rack.

Figure 5B:
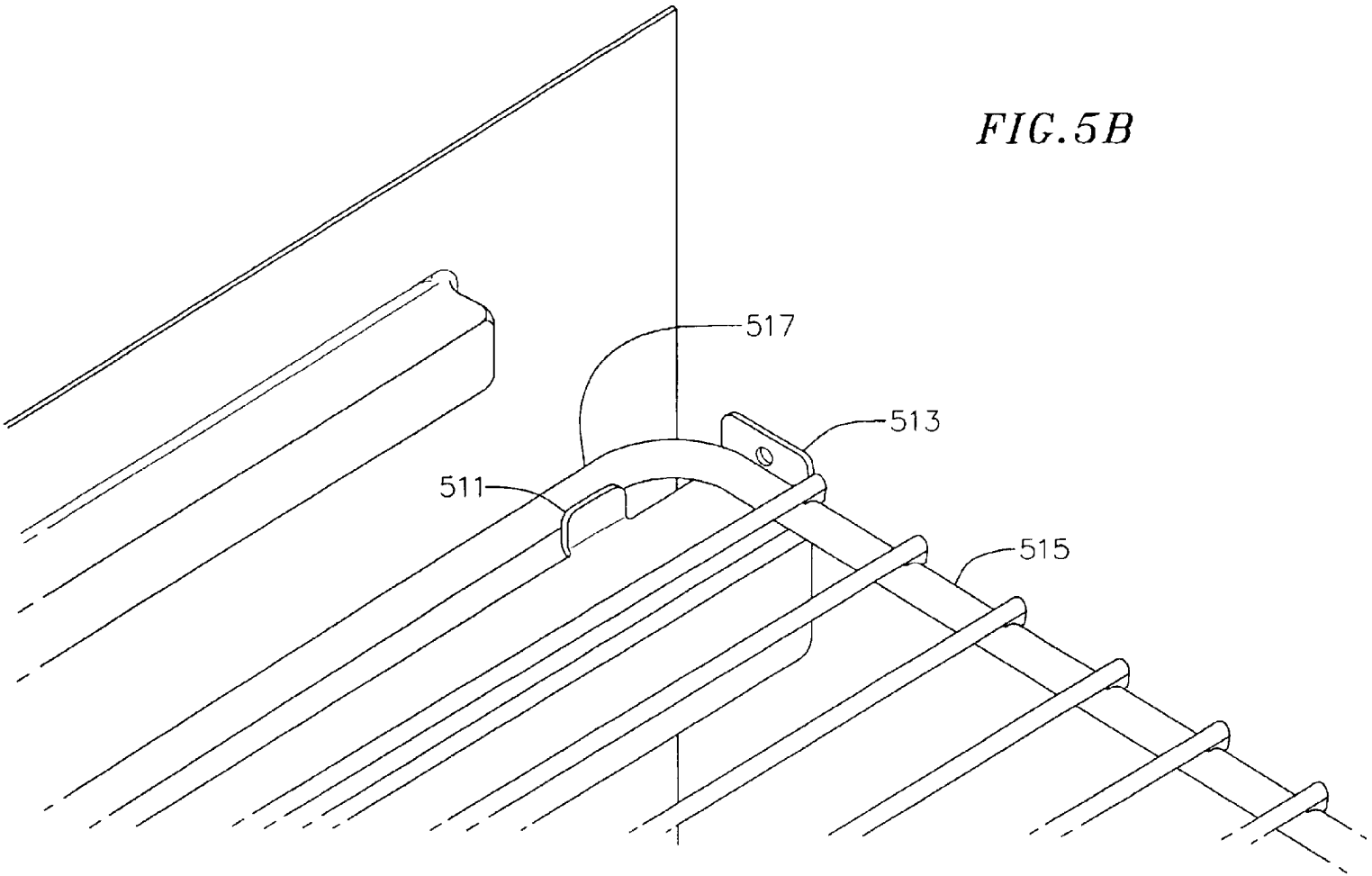
FIG. 5*b* illustrates the slide accessory of FIG. 5*a* with a rack.

FIG. 5*b* illustrates a rack 515 placed against a side wall 511 and an abutment 513. As illustrated in FIG. 5*b*, the abutment is in the interior portion of the rack, with a side bar 517 of the rack somewhat maintained in position by the side wall. In some embodiments, the side wall is placed sufficiently close to the abutment such that a side wall serves to prevent motion of the rack in two directions due to the curvature of the rack contacting an edge of the side wall.

Figure 5C:
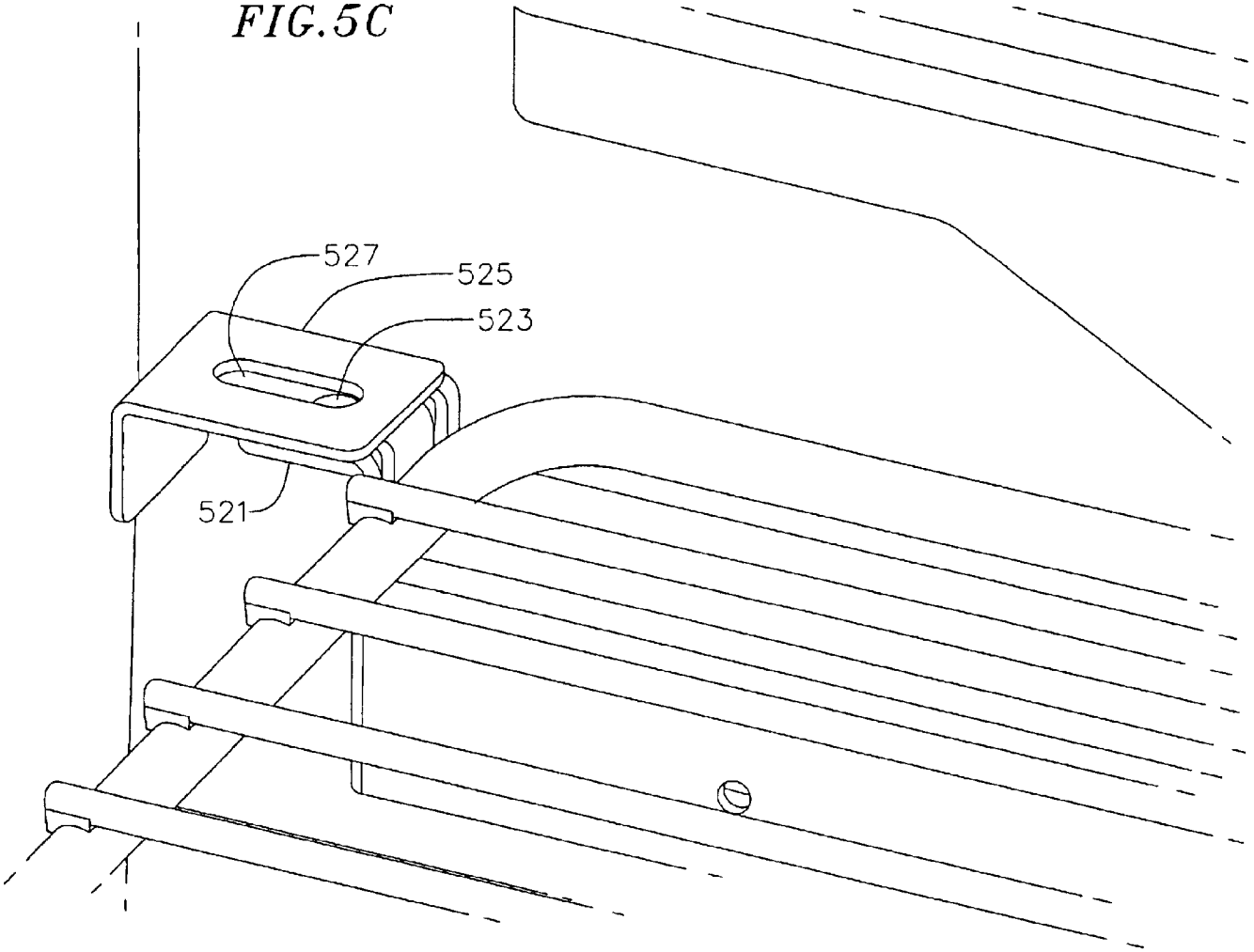
FIG. 5*c* illustrates a further slide accessory useful with the slide of FIG. 3 and an associated rack.
Figure 5D:
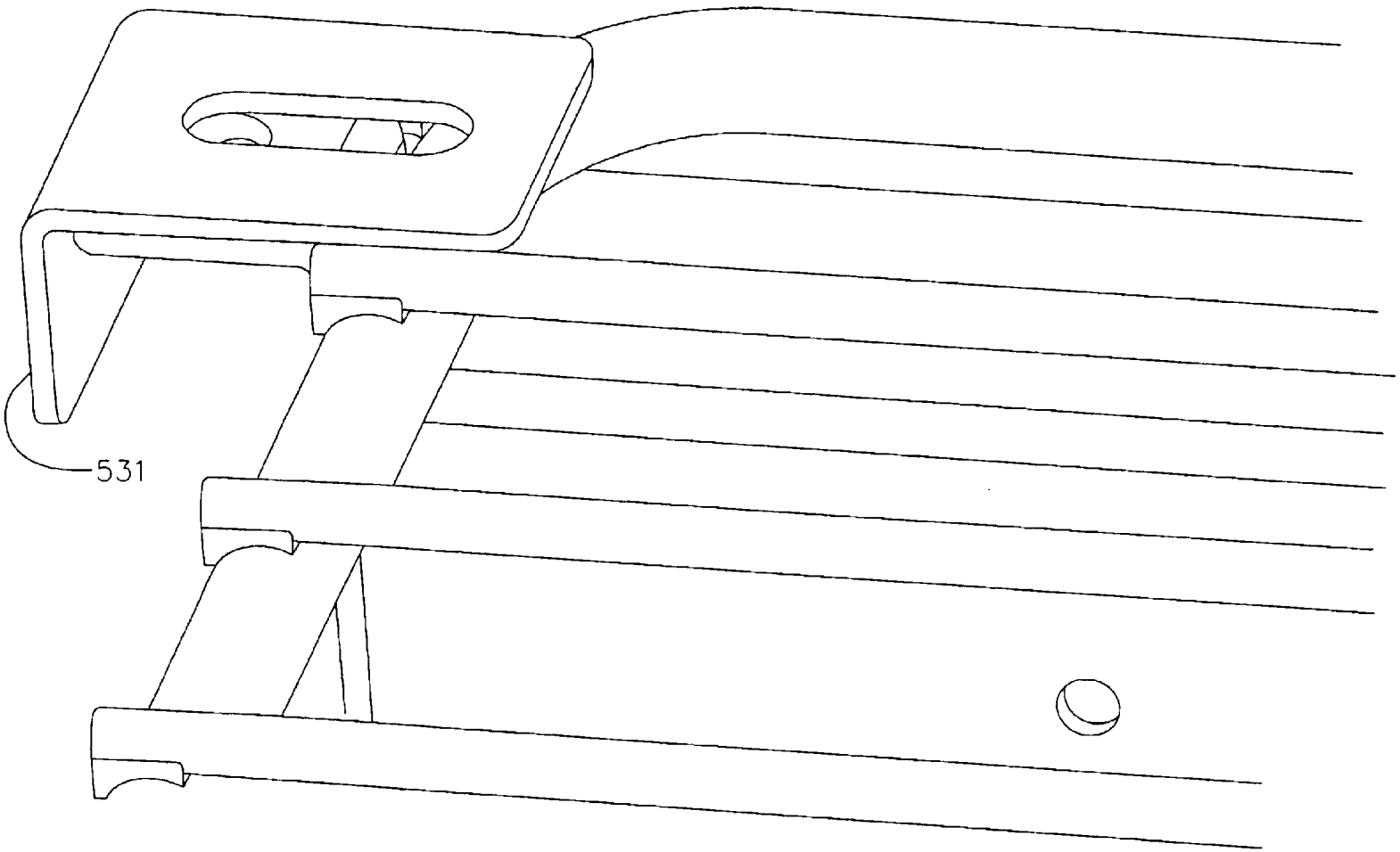
FIG. 5*d* illustrates the slide accessory and rack of FIG. 5*c* with the rack held in place.

FIG. 5*c* illustrates a further retention feature useful with L-shaped bracket accessories. In FIG. 5*c* a tab 521 extends from the abutment. The tab includes a small post 523. The post may be formed, for example, using a rivet. A sliding bracket 525 is coupled to the tab, the sliding bracket having an elongated slot 527. The slot is adapted to receive the post. As illustrated in FIG. 5*c* the bracket is positioned away from the rack, and the rack may be released from the accessory. FIG. 5*d* illustrates the bracket slid forward over the rack, maintaining the rack in position. Conveniently, the sliding bracket is somewhat L-shaped, thereby providing both a stop 531 while maintaining the rack in position as well as a handle 531 to move the sliding bracket.

Figure 6:
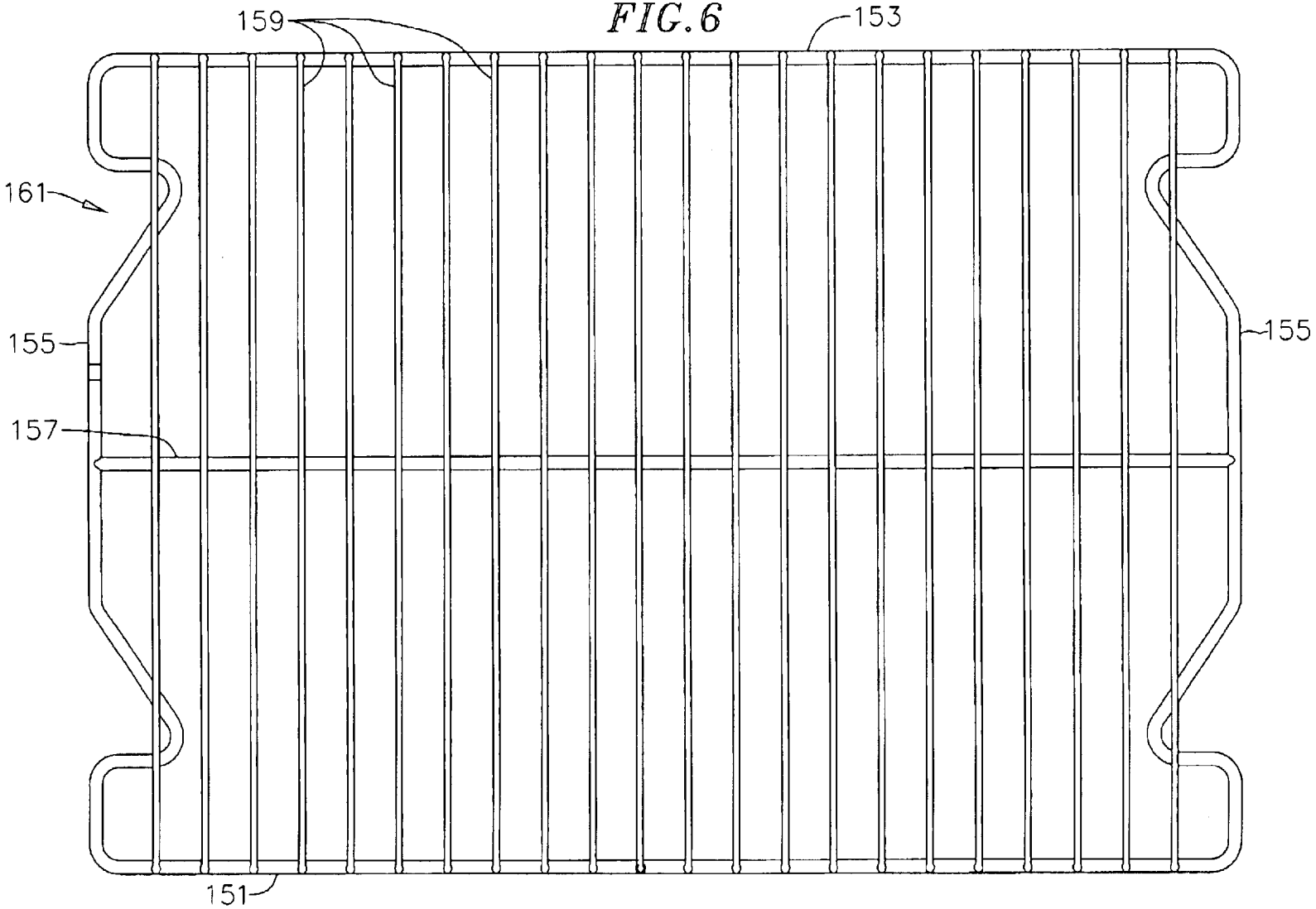
FIG. 6 illustrates an embodiment of a rack used in the present invention.

Turning now to the rack, FIG. 6 illustrates a rack adapted for use with the present invention. The rack comprises a forward bar 151, a rear bar 153, and side bars 155 interconnecting the forward and rear edges. Approximately at the half-way point of the side bars, a support bar 157 is placed with interconnects the two side bars. Rack bars 159 are placed from the front edge to the rear edge, with the spacing of the rack bars adapted for placement of items on the rack. The support bar provides additional support for the rack bars. As illustrated, the side bars include an inward angled bend 161. The inward angled bends provide additional structural stability to the rack, as well as providing a surface adapted for placement against the angled abutment of the mounting accessory.

Figure 7:
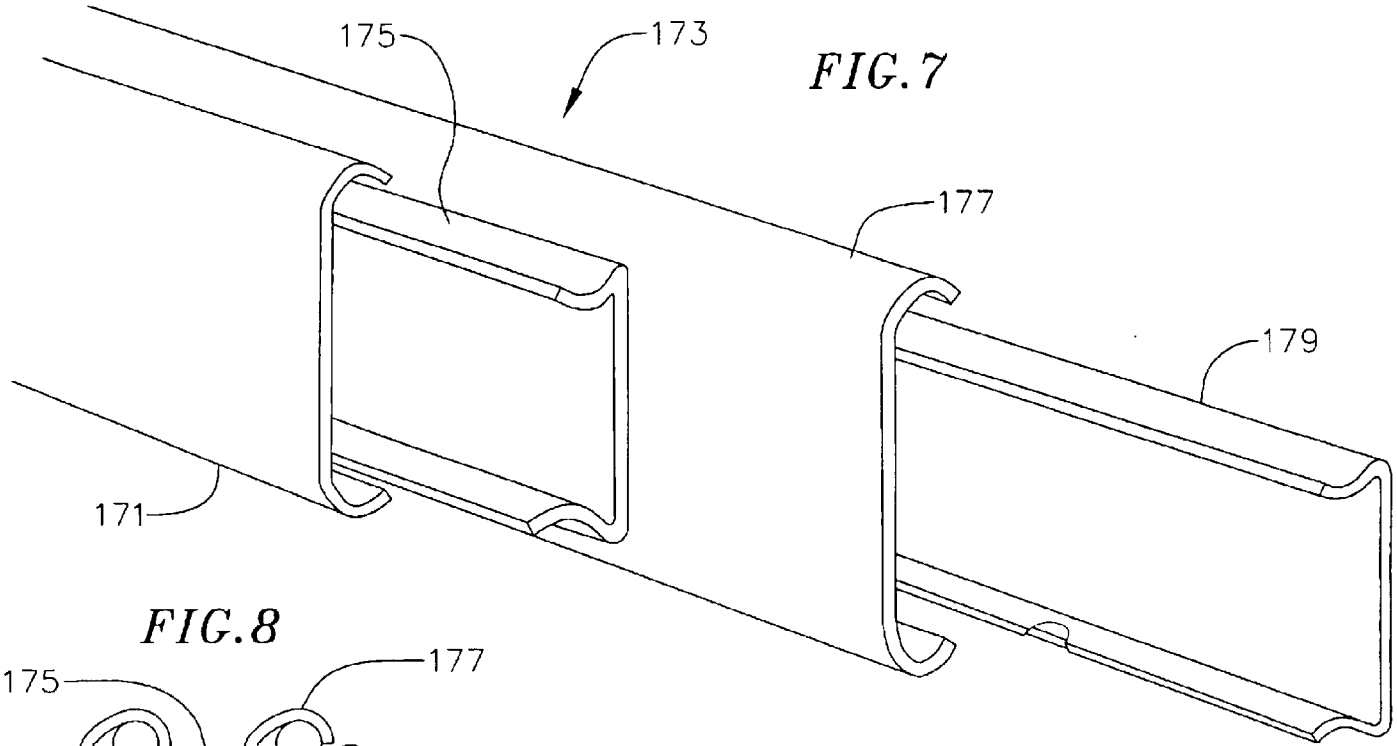
FIG. 7 is a perspective view of an alternative slide used in embodiments of the invention.

FIG. 7 illustrates a perspective view of an alternative slide used in embodiments of the invention. The alternative slide is a hybrid parallel and telescopic slide. As illustrated, the hybrid slide is a full extension slide, with three slide members. A first slide member 171 is substantially C-shaped with a planar web and bearing raceways along the length of the planar web. A second slide member 173, which may also be called an intermediate slide member, includes a first C-shaped section and a second C-shaped section 177. The two C-shaped sections face away from each other, and are coupled together through welding or embossing or the like.

For the second, or intermediate, slide member, the first C-shaped section 175 is of reduced dimension compared to the second C-shaped section 177. The first C-shaped section is dimensioned adapted to fit within the C-shaped section of the first slide member. Bearings riding in the bearing raceways of the section and the slide member couple the slide members together in a slidable, or rollable, fashion.

A third slide member 179 is coupled to the second C-shaped section of the intermediate slide member by bearings. The third slide member is dimensioned to fit within the second C-shaped section of the intermediate slide member. Accordingly, the alternative slide has features of a parallel, or side-by-side, slide, yet also has features of a telescopic slide.

Figure 8:
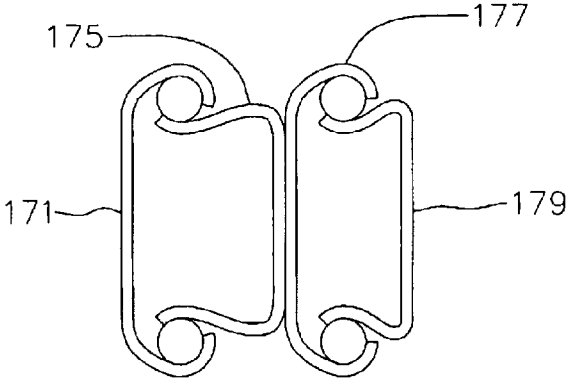
FIG. 8 is a cross-section of the slide of FIG. 7.

As can be seen in the cross-sectional view of FIG. 8, the alternative slide includes four major components. The four major components are the first slide member 171, the first C-shaped section of the second slide member 175, the second C-shaped section of the second slide member 177, and the third slide member 179, which may be termed first, second, third and fourth components, respectively. As illustrated, and providing conveniences in manufacture, the first and third components are similarly dimensioned, as are the second and fourth components.

Conveniently, in some embodiments the assembly of the present invention includes features providing for maintenance of the rack at a position within the oven, at a position of intermediate extension from the oven, and at a position fully extended from the oven. Such a feature is convenient in that inadvertent movement of the rack from positions at which items on the rack are commonly handled may be inconvenient. In addition, the features allow for improved sequencing of the drawer slide to avoid bearing drift and uneven load distribution. These features are sometimes termed detent features, with a detent providing a frictional interface, either in one direction, an opposing direction, or both directions, with the frictional interface requiring an increased force to allow for movement of the slide.

Figure 9:
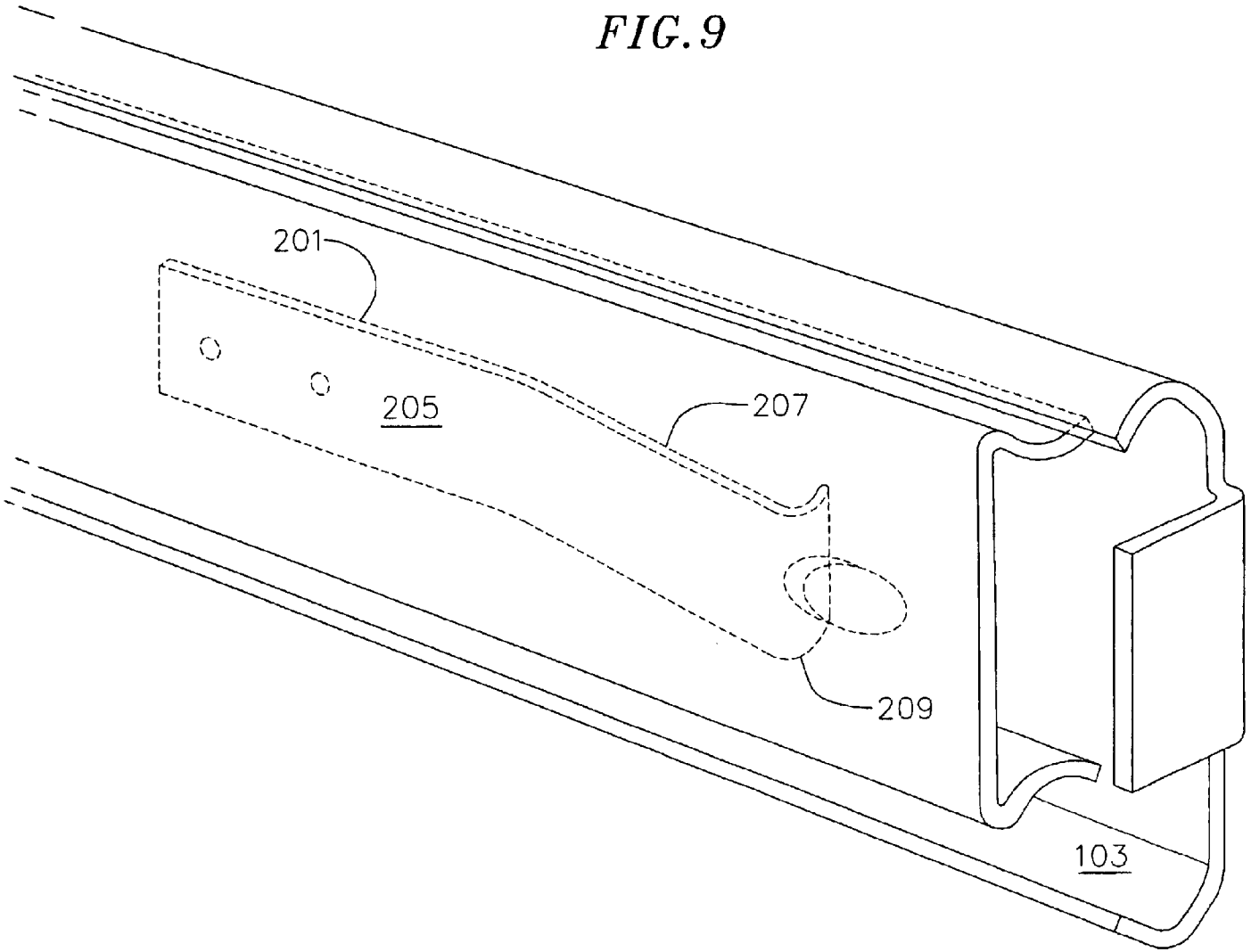
FIG. 9 illustrates a detent in mechanism of the slide of FIG. 7.

A detent-in mechanism for the slide of FIG. 7 is illustrated in FIG. 9. The term detent-in refers to a detent in the fully retracted position within the oven. As illustrated, a strip of material 201 is affixed to an inner portion of a web 103 of a slide member. The strip of material includes a flat portion 205 affixed to the web, and a tongue 207 extending away from the web at a slight angle. A leading edge of the tongue is bent towards the web of the slide member to provide a rounded leading surface 209. Due to stiffness in the material, metal in one embodiment, the tongue serves as a leaf spring. In operation, the tongue extends a sufficient distance from the web of the slide member to contact a protrusion extending towards the spring from the web of the meeting slide member. As a protrusion rides up and over the tongue, increased force is required for continued movement of the drawer slide. Similarly, to open a slide requires passage of the protrusion over the forward edge of the tongue. Conveniently, the rounded leading edge of the tongue allows for deflection of the leaf spring without the protrusion catching the leading edge of the tongue.

In the slide of FIG. 7, the leaf springs are attached to the first slide member and the larger cross-sectional piece of the second slide member. The protrusions are placed on the third slide member and the smaller cross-sectional portion of the second slide member. Thus, the reduced cross-sectional pieces, namely the first section of the intermediate slide member and the third slide member, have similar designs, as do the larger cross-sectional pieces, namely the first slide member and the larger section of the intermediate slide member. Moreover, such placement of the leaf springs and protrusions provides for a detent function at the full end position and at an intermediate position.

Figure 10:
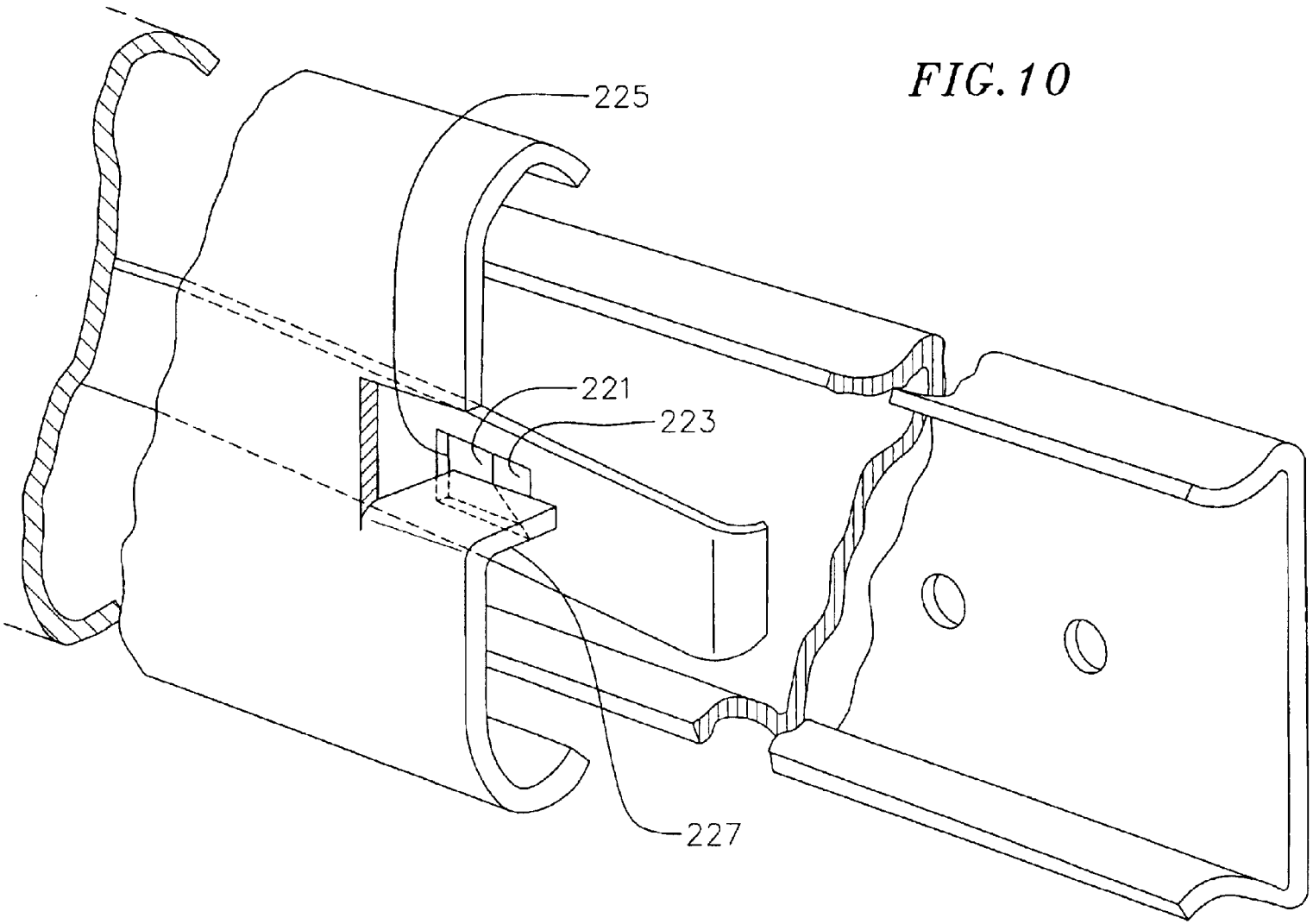
FIG. 10 illustrates a detent out mechanism of the slide of FIG. 7.

FIG. 10 illustrates a detent-out mechanism of the slide of FIG. 7. The detent-out mechanism, like the detent-in mechanism, makes use of a leaf spring. The leaf spring of the detent-out mechanism, however, includes a aperture 221 near the leading edge of the tongue of the leaf spring. The leading edge of the aperture includes a ramp surface 223, while the following edge 225 is a simple abutment.

A tab 227 is lanced in the web of an opposing slide member, with the tab adapted to be positioned in the aperture of the leaf spring. As the slide including the leaf spring is extended the tab hits the leading edge of the leaf spring, forcing the leaf spring down and providing a frictional interface. The tab then moves into the aperture, with the spring action of the leaf spring allowing for increased movement of the tab into the aperture. Once in the aperture, contact between the tab and following edge of the aperture prevents further motion of the slide. If, however, removal of a slide member from the slide assembly is desired, depression of the leading edge of the tongue, which extends beyond the slide member, allows for easy removal of the slide member. The tab and spring therefore serve as a lock feature as well.

Returning to the detent feature, retraction of the slide requires that the tab slide over the ramp of the leaf spring. The ramp also provides a frictional interface, and therefore stably holds the slide in the extended position.

Conveniently the leaf spring is attached to the smaller slides and/or cross-sections, with tabs at the leading edges of the slide components having larger cross-sections. Thus, the leaf spring and tabs provide both a detent out and a lock feature.

Figure 11:
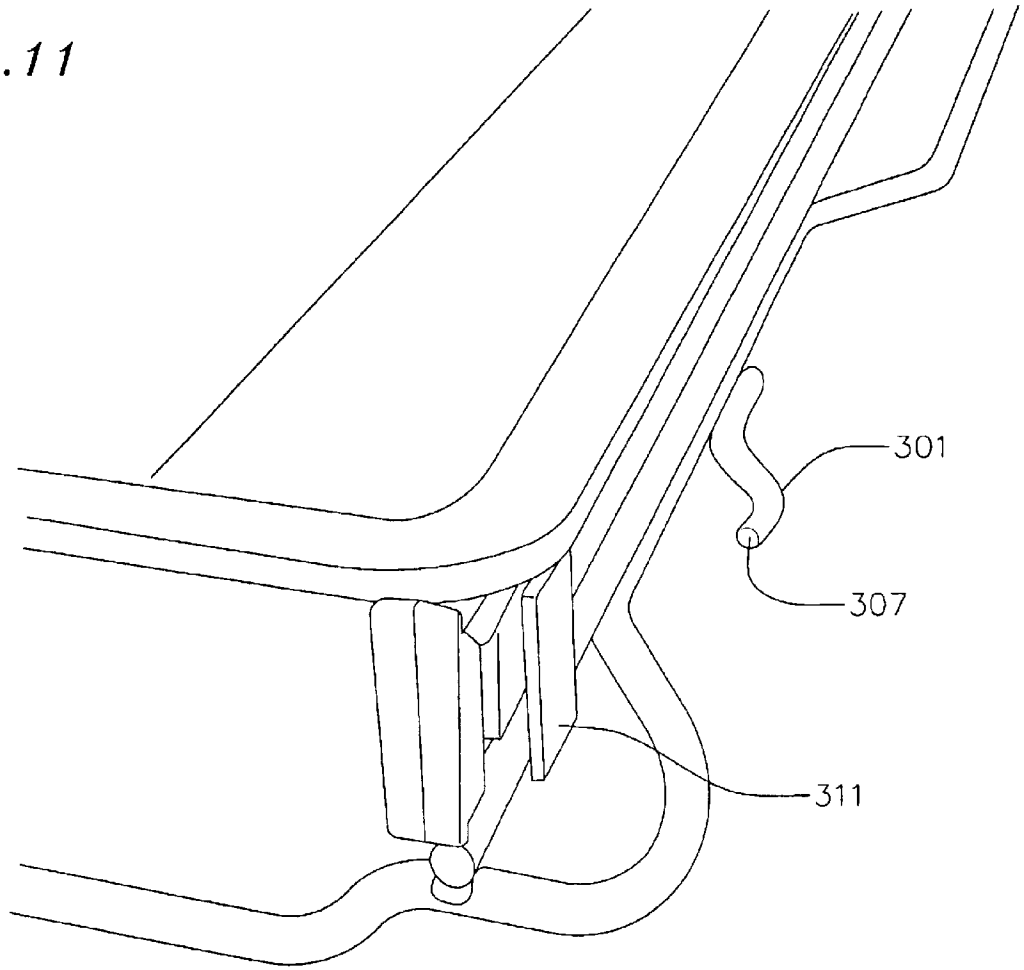
FIG. 11 illustrates an oven and rack assembly using a holding tab useful in some embodiments of the invention.

In the embodiment of FIG. 1 retention of the rack frame within the oven was accomplished through use of angled side bars such that the rear bar contacts another ledge. The contact of the rear bar and the end of another ledge prevents forward motion of the rack frame. Removal of the rack frame from the oven in such an embodiment is accomplished by tilting the assembly such that the rear bar no longer contacts another ledge. FIG. 11 illustrates an embodiment in which tilting of the assembly is not used to remove the rack frame from the oven. Instead a tab extends from the rack frame. The tab is adapted to contact a downward protrusion near the front of the bottom of another ledge. Contact of the tab and the protrusion from the ledge prevents forward movement of the rack frame. The tab, however, extends at an angle from the rack frame and somewhat provides a spring effect, with the tab forming a leaf spring. The application of increased force in pulling the assembly from the oven results in the tab bending and passing past the protrusion on the ledge. In such a manner the rack then may be removed from the oven.

Figure 11A:
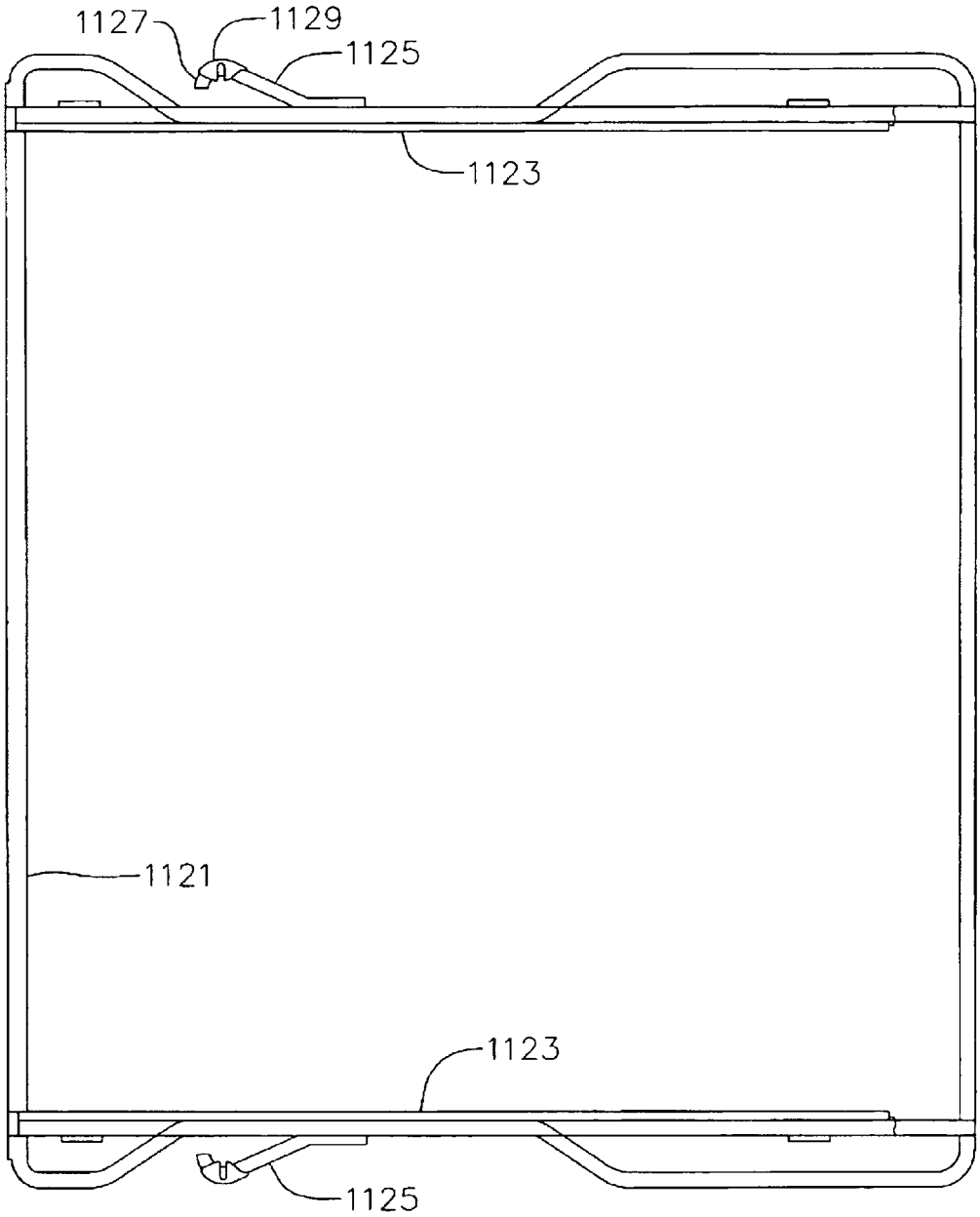
FIG. 11A is a top view of the rack frame and slide assembly of FIG. 11.

FIG. 11A is a top view of the rack frame and slide assembly of FIG. 11. Thus, the rack frame and slide assembly includes a rack frame 1121 and attached slides 1123. Also included are tabs 1125 extending from the wire frame. The tabs serve as a leaf spring pressing against side walls of an oven enclosure (not shown). In the embodiment of FIG. 11A, an outward edge 1127 of the tab includes a plastic insert 1129. The plastic insert mounts about the leading edge of the tab approximate the oven wall enclosure. The plastic insert, which in some embodiments is a high temperature plastic, provides a cushioning effect so as not to scratch the walls of the oven enclosure.

Figure 11B:
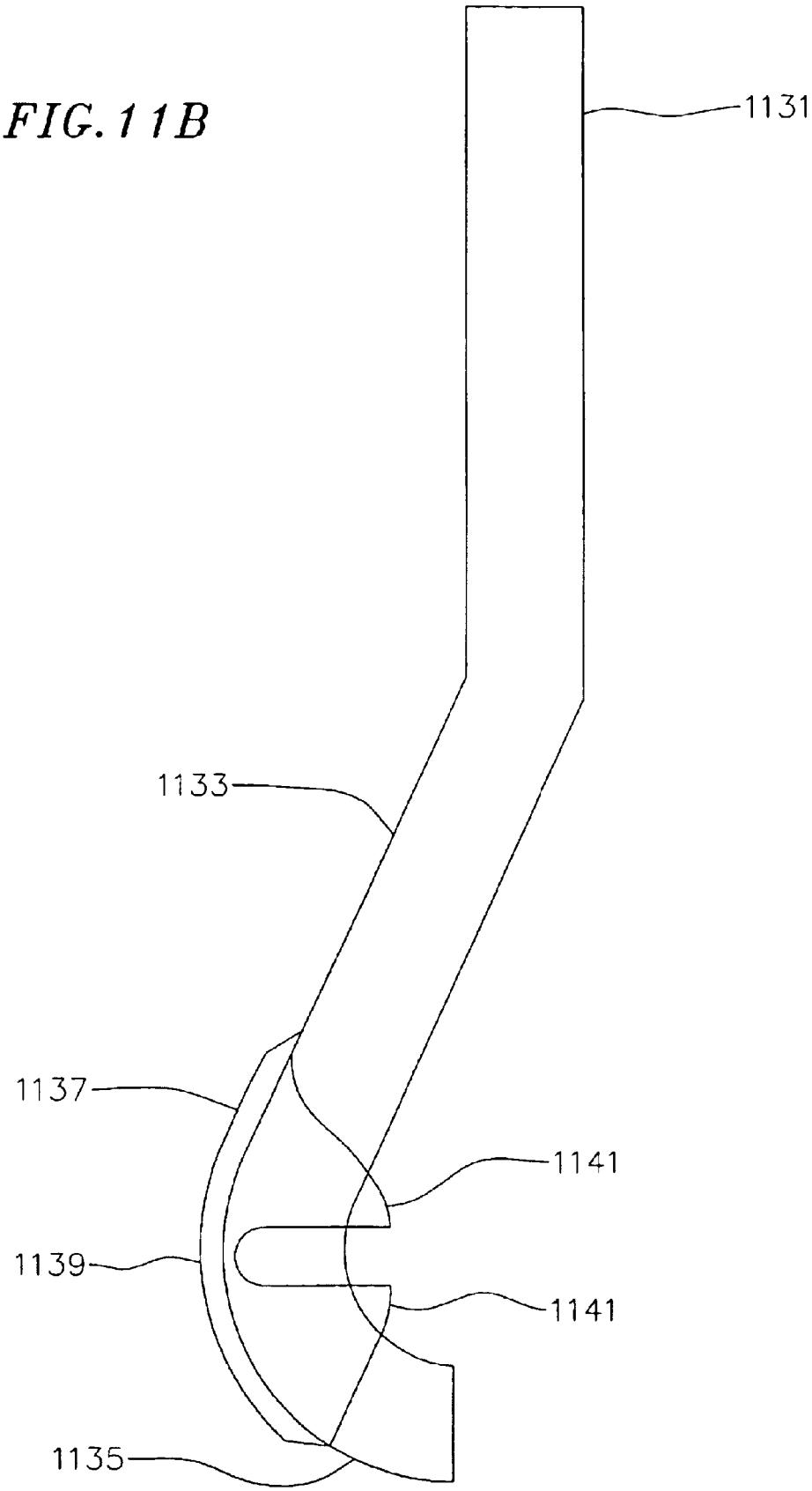
FIG. 11B is a further view of the tab and plastic insert of FIG. 11A.

FIG. 11B is a further view of the tab and plastic insert of FIG. 11A. As illustrated in FIG. 11B, the tab includes a first linear portion 1131 adapted for welding or the like to a rack frame. An extending portion 1133 with a rounded leading edge 1135 provides a leaf spring effect. About the rounded leading edge is a plastic clip. The plastic clip includes a arc-shaped surface configured to snuggly fit against the rounded leading edge of the tab. Two gripping clips 1141 extend from the arc, and are adapted to grip the leading edge of the tab.

Figure 11C:
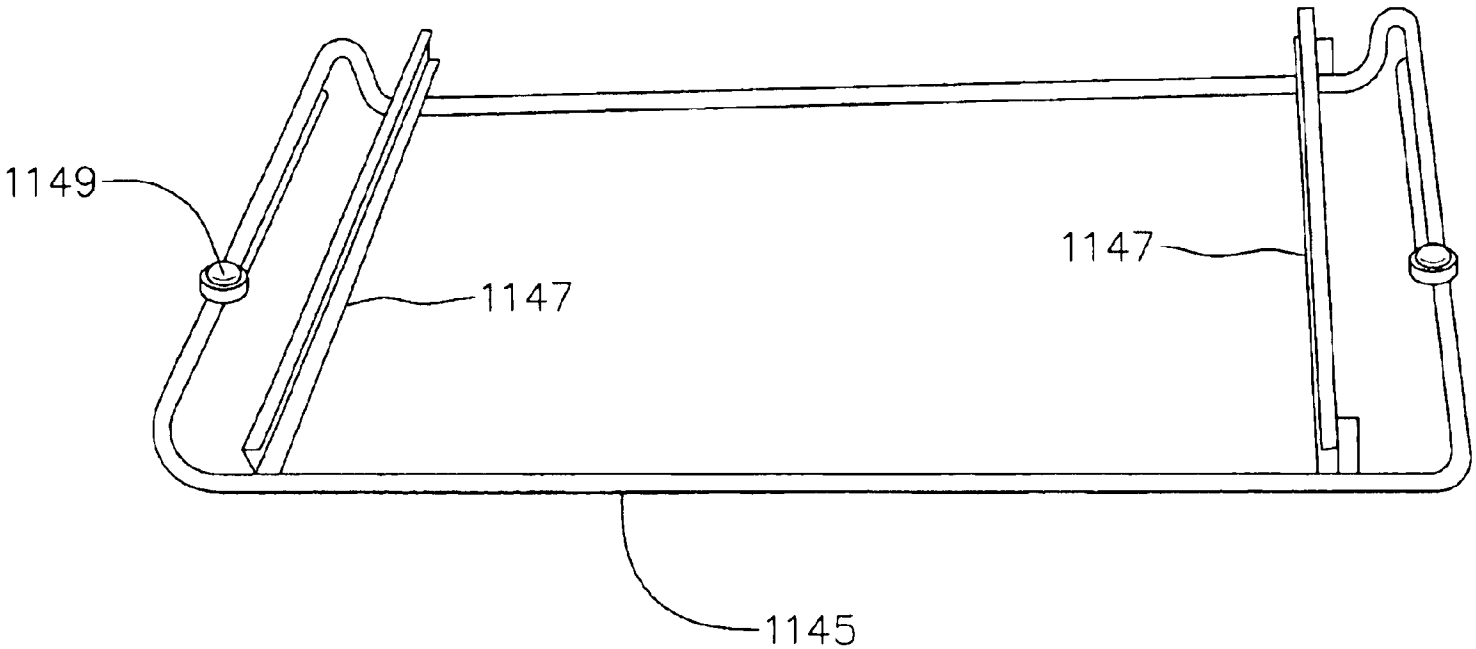
FIG. 11C illustrates a further extendable rack frame.

FIG. 11C illustrates a further extendable rack frame for mounting in an oven using ledges along the oven sidewalls. The assembly of FIG. 11C includes a wire rack frame 1145 with coupled slides. A wire rack (not shown) for the placement of food stuffs and the like would be mounted to the slides. A roller 1147 is mounted to opposing edges of the rack frame. The roller is rotateable such that as the rack frame is inserted into the oven enclosure the roller rolls against the side walls of the oven enclosure. The material of the roller is preferably a high temperature plastic, such as PEEK. The roller is of particular utility if the side ledges of the oven wall include end-stop stampings which provide a frictional interface, or detent, for stable position of the rollers in the end stops. This allows extension of the frame coupled to the slides to extend from the oven enclosure without movement of the rack frame.

Figure 11D:
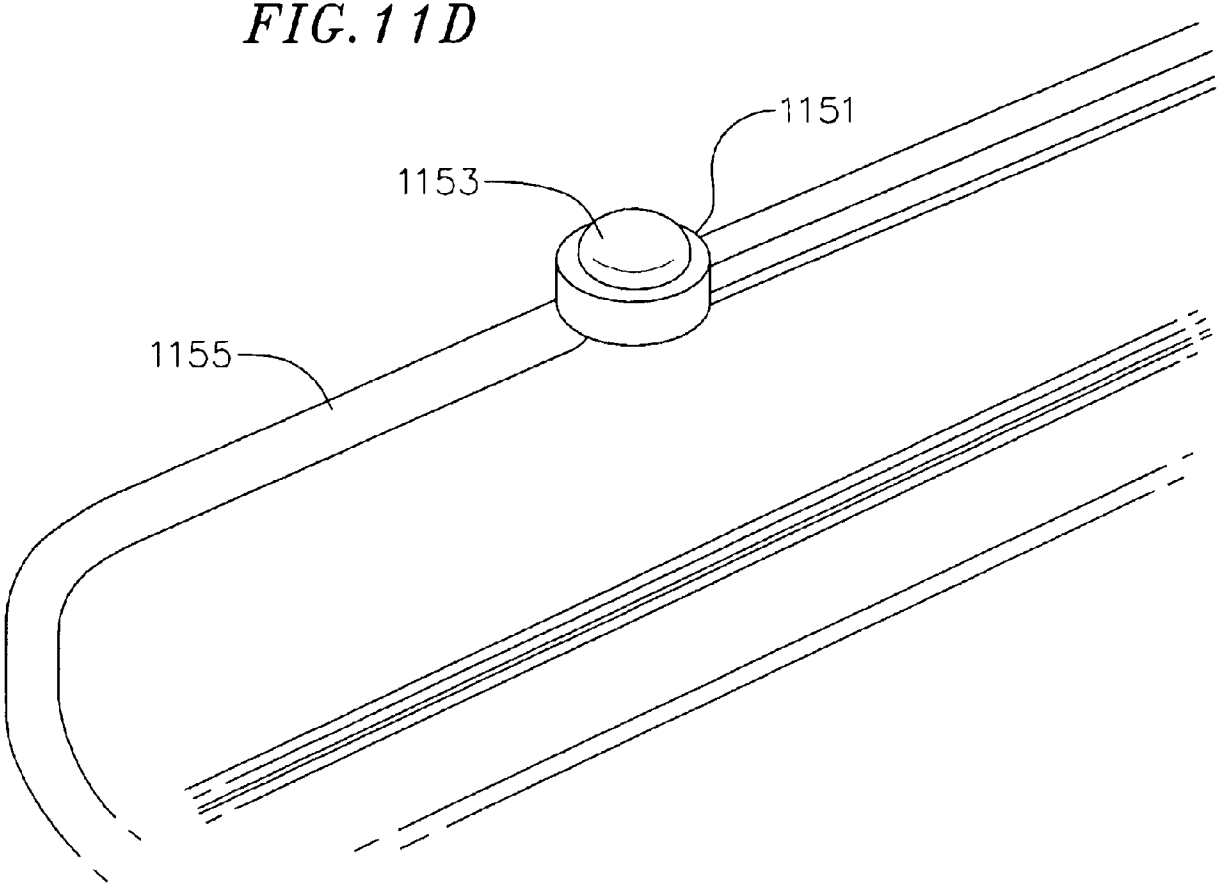
FIG. 11D show a further view of a roller of FIG. 11C.

FIG. 11D shows a further view of the roller 1151. The roller is mounted to a post 1153 attached to the rack frame 1155, with the post extending virtually from the rack frames. The roller is mounted horizontally about the post.

Figure 12:
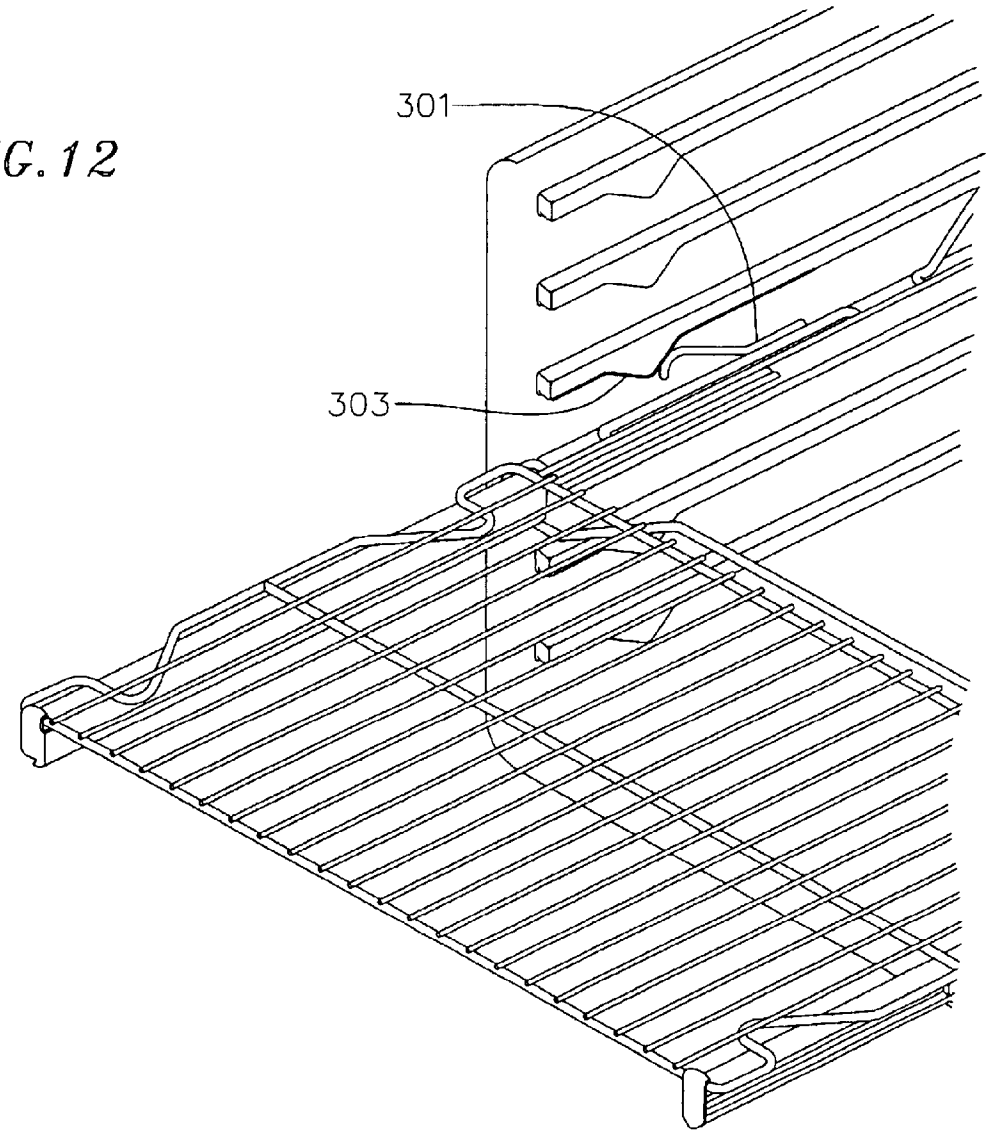
FIG. 12 illustrates a rack frame with the holding tab of FIG. 11 in some embodiments of the present invention.

FIG. 12 illustrates a tab extending from the rack. In the rack of FIG. 12, the rack includes forward and rearward portions adapted to rest on a ledge. An intermediate portion of the side bar is at an inset. A bar is attached to the inset, with one end of the bar extending away from the inset and forming a leaf spring. The forward edge of the leaf spring is angled back towards the rack frame. In operation, the angled portion contacts a protrusion from the ledge of the oven. Application of force, either in insertion into the oven or extraction from the oven, results in flexing of the tab and the frame passing by the ledge.

Also indicated in FIG. 12 is an alternative method of mounting a rack frame to a slide. In the embodiment of FIG. 12, a flange is affixed to a portion of the rack frame. The flange extends upward from a plane formed by the rack frame. The upwardly extending portion of the flange is affixed to a web of a drawer slide.

Figure 13:
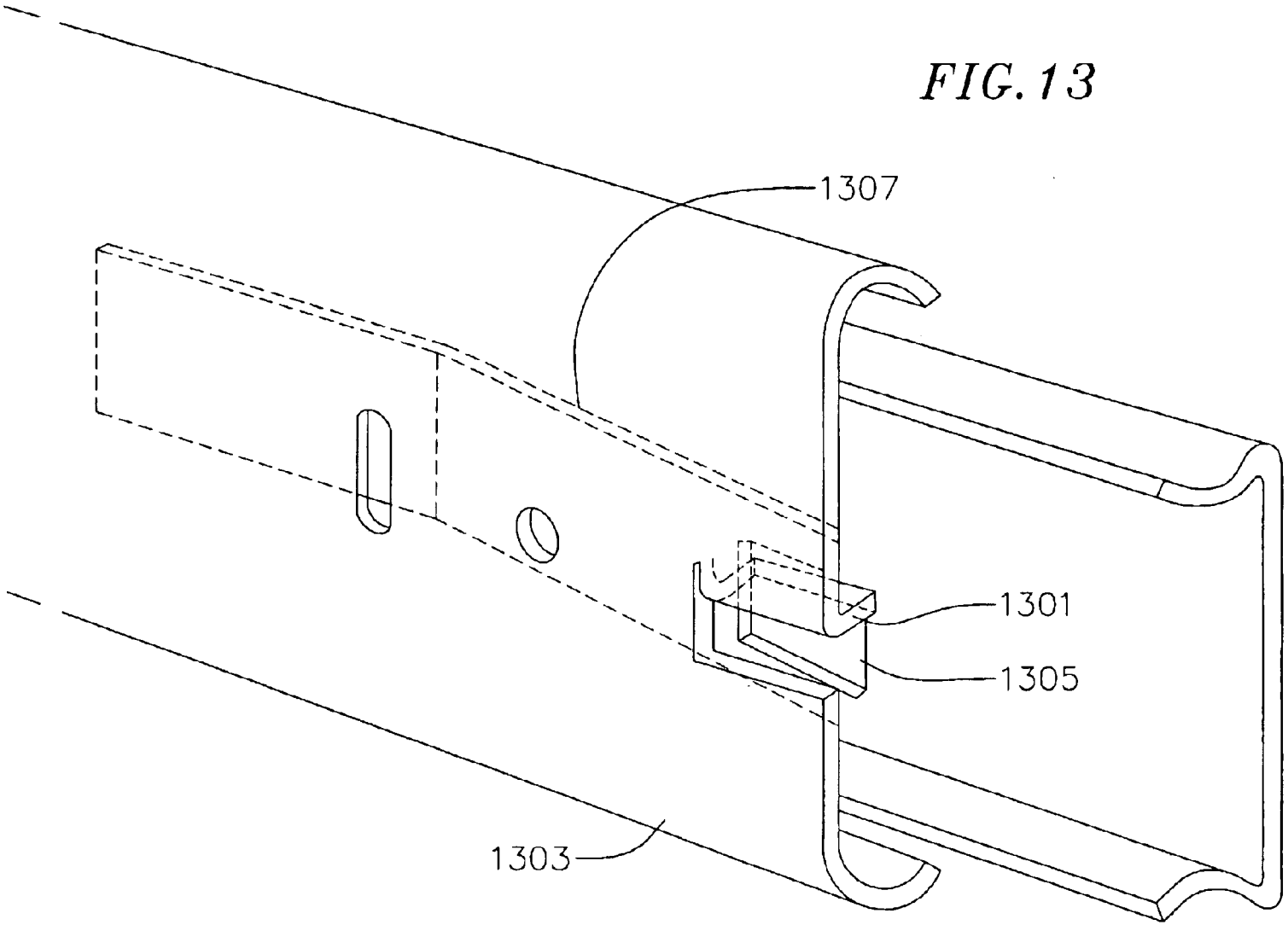
FIG. 13 illustrates a lock mechanism useful in some embodiments of the invention.

FIG. 13 illustrates a lock-out feature useful in some embodiments of the present invention. The lock-out feature of FIG. 13 includes a tab 1301 lanced from a first slide member 1303 which is insertable into a aperture 1305 of a leaf 1307 spring mounted on the web of another slide member. Features of this lock-out tab are in some ways similar to those previously described.

Figure 14:
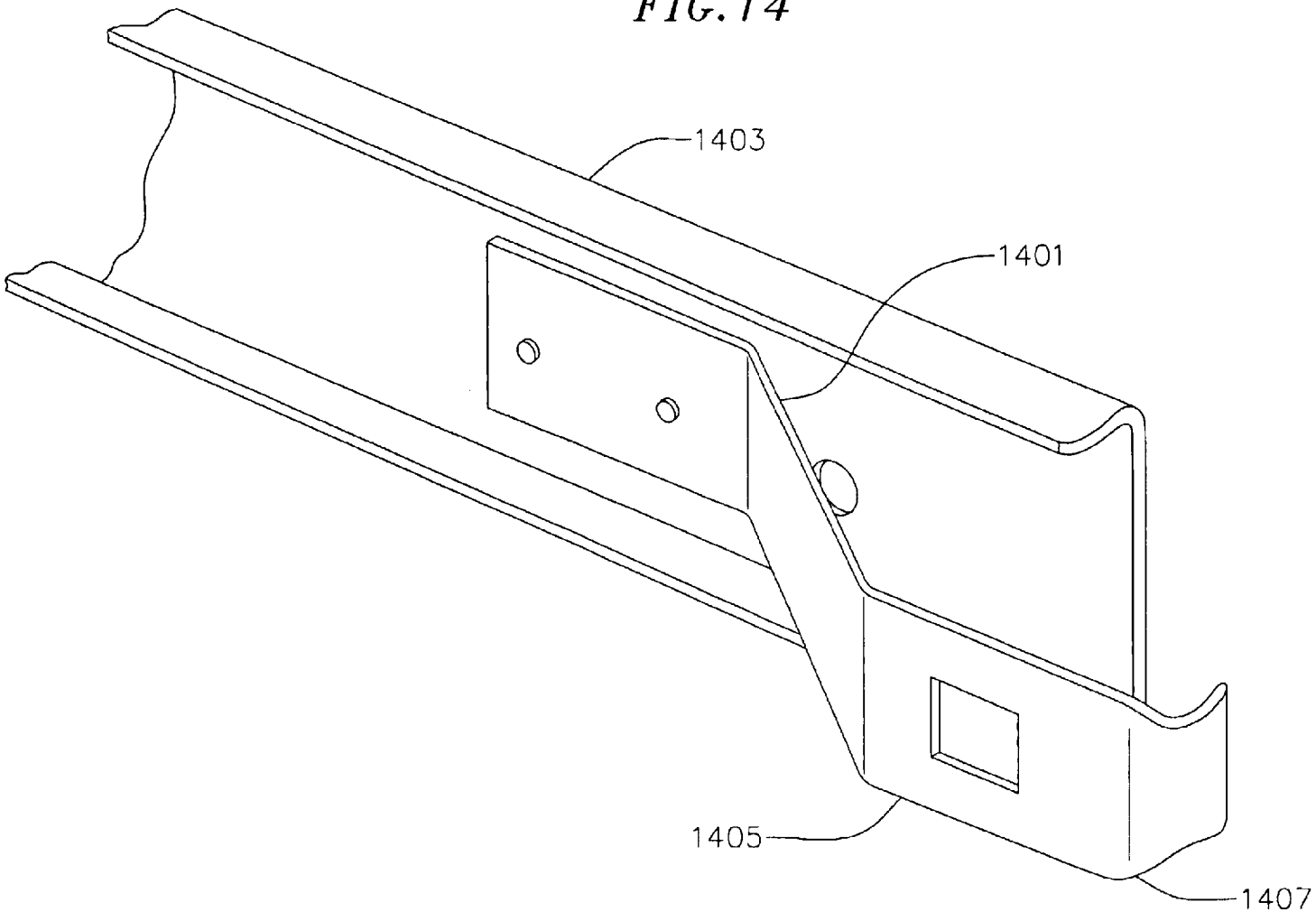
FIG. 14 illustrates a further lock mechanism useful in some embodiments of the invention.
Figure 15:
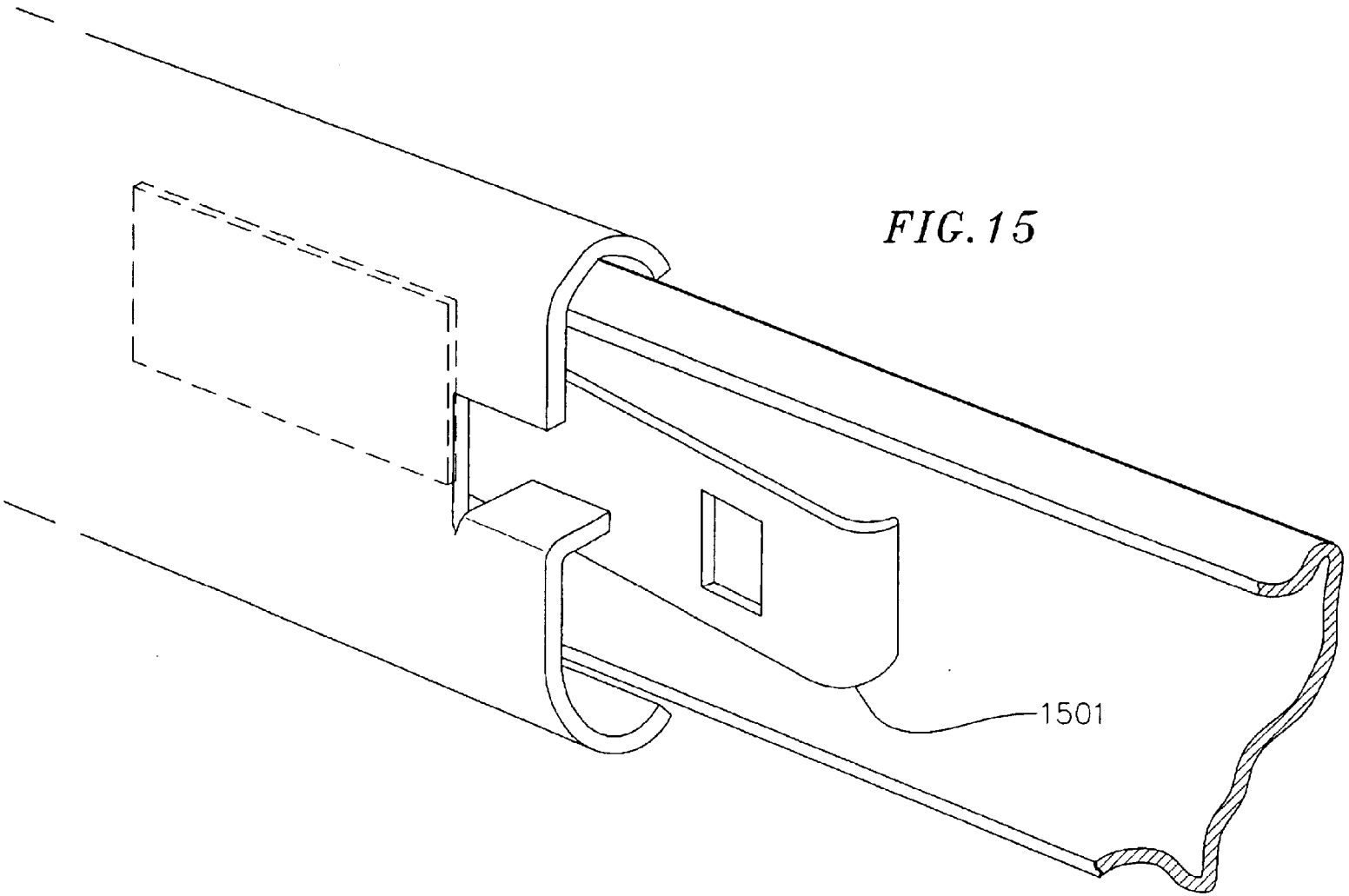
FIG. 15 illustrates a further lock mechanism useful in some embodiments of the invention.

FIG. 14 illustrates a further leaf spring useful in some embodiments of the invention. As illustrated, the leaf spring includes a first angled portion 1401 extending away from a drawer slide member 1403 to which the leaf spring is mounted, a second portion 1405 substantially parallel to a drawer slide member web, and a rounded leading edge 1407. As illustrated, an aperture is located in the parallel portion of the leaf spring. FIG. 15 illustrates a further lock-out mechanism, which in many ways is similar to that illustrated in FIG. 13, but with additional detail including a rounded leading edge of the leaf spring.

Figure 16:
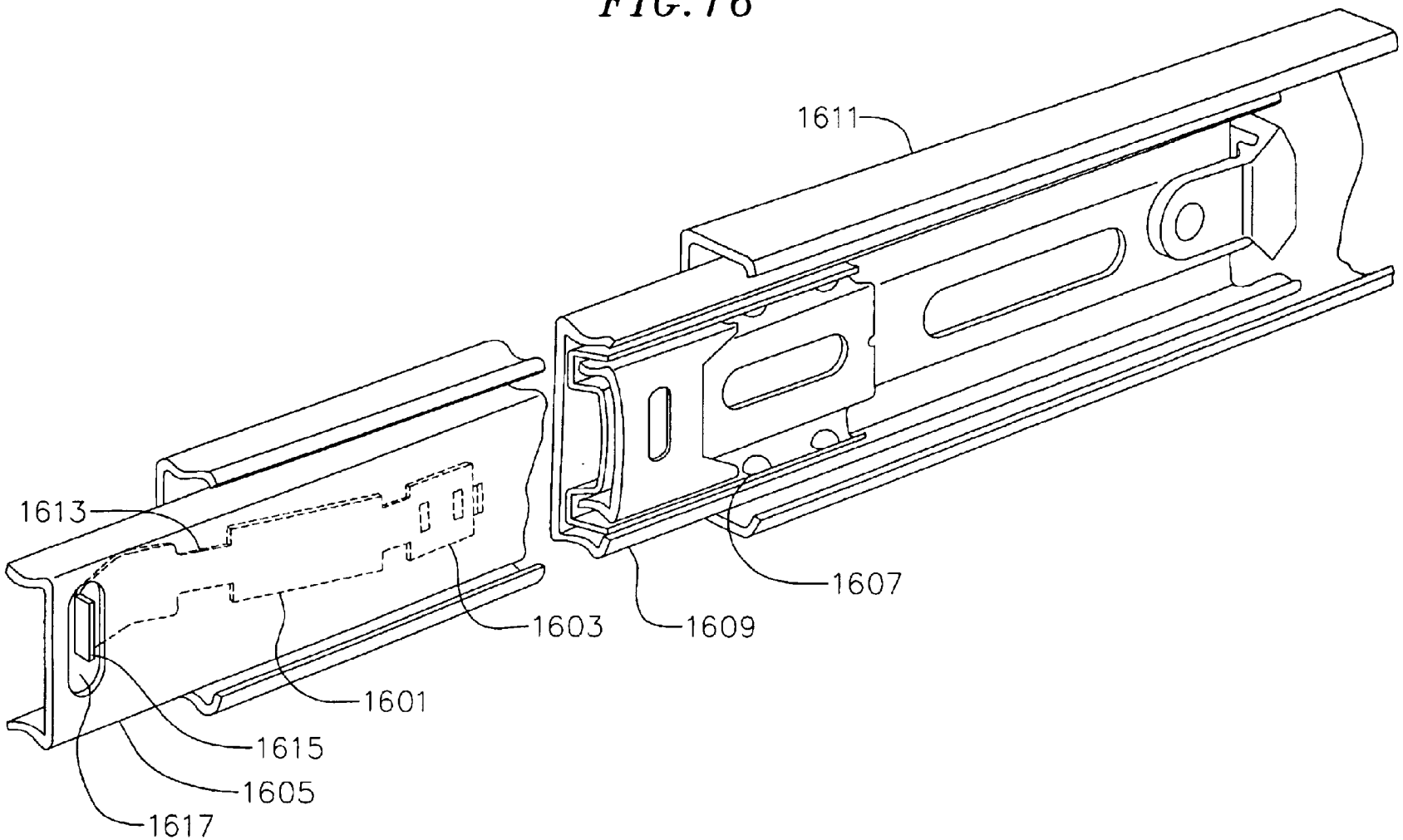
FIG. 16 illustrates a further lock mechanism useful in some embodiments of the invention.

FIG. 16 illustrates a lock-out mechanism for a three-member telescopic slide useful in some embodiments of the invention. The lock-out mechanism includes an arcuate flexible strip 1601 affixed at one end 1603 to an inner member drawer slide 1605. The inner member is coupled by bearings 1607 to an intermediate member, which in turn is coupled to an outer member 1611. The arcuate strip includes notches 1613 about the middle, with the notches adapted to catch tabs (not shown) extending from the intermediate member. The flexible strip includes a curved forward end forming a tab 1615 extending towards the web of the inner member. A slotted aperture 1617 is placed within the web of the inner member, with the tab positioned so that depression of the flexible strip towards the web of the inner member allows the tab to pass through the aperture. Depression of the flexible strip also allows the notches in the flexible strip to pass by the tabs extending from intermediate member unimpeded.

Figure 17:
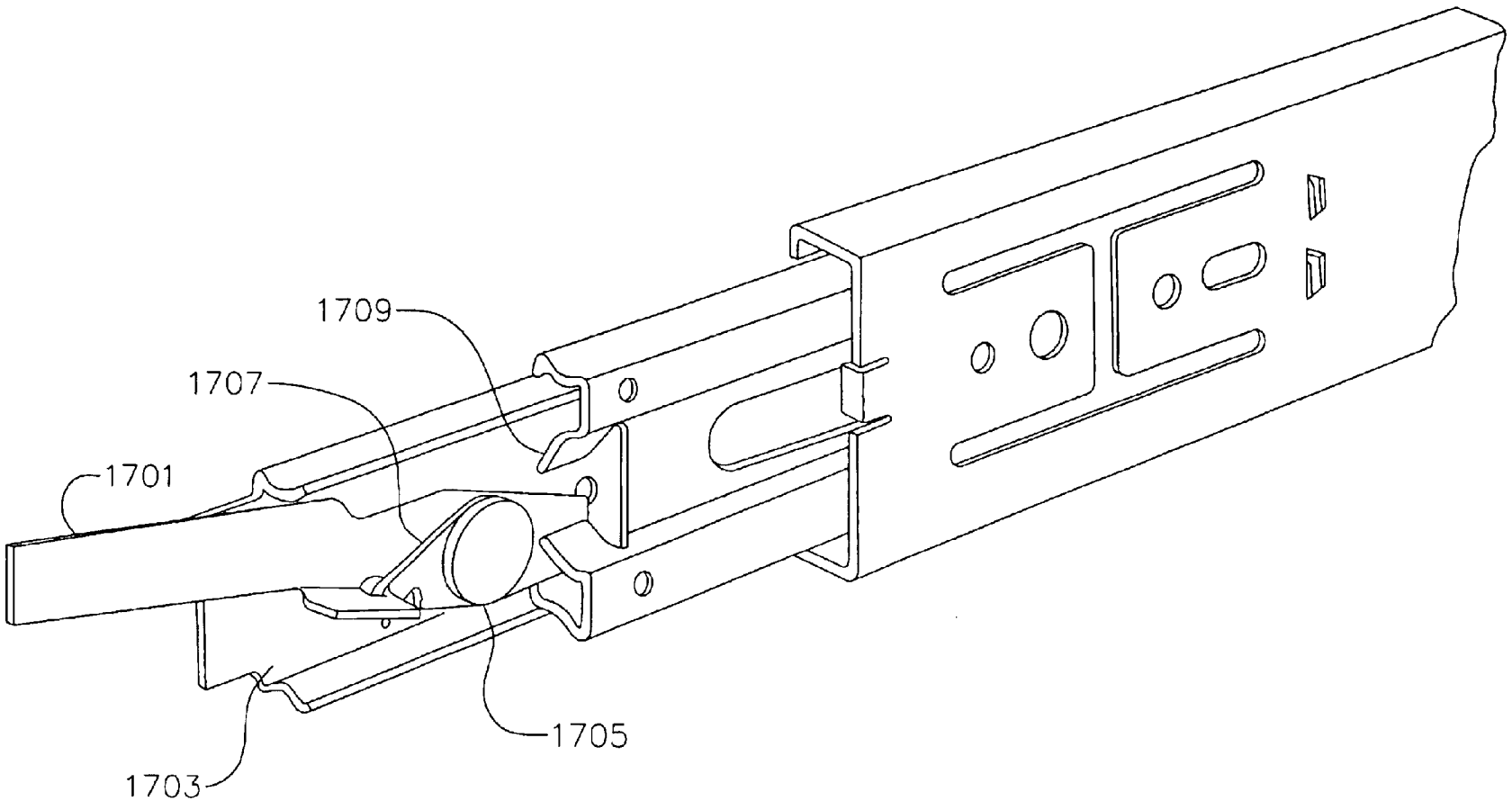
FIG. 17 illustrates a further lock mechanism useful in some embodiments of the invention.

FIG. 17 illustrates a locking mechanism for a three-member telescopic drawer slide. The locking mechanism includes a biasable arm 1701 affixed to an inner member web 1703 of a three-member drawer slide. The biasable arm is affixed by means of a rivet 1705 towards one end. A spring 1707 is used to normally bias the arm in a first position, which catches a tab 1709 on the intermediate member maintaining the slide in position.

Telescopic slides have been discussed in detail for use in the present invention. Telescopic slides are embodiments of full extension slides. Those skilled in the art will appreciate that other embodiments of full extension slides may also be used in the present invention.

Figure 18:
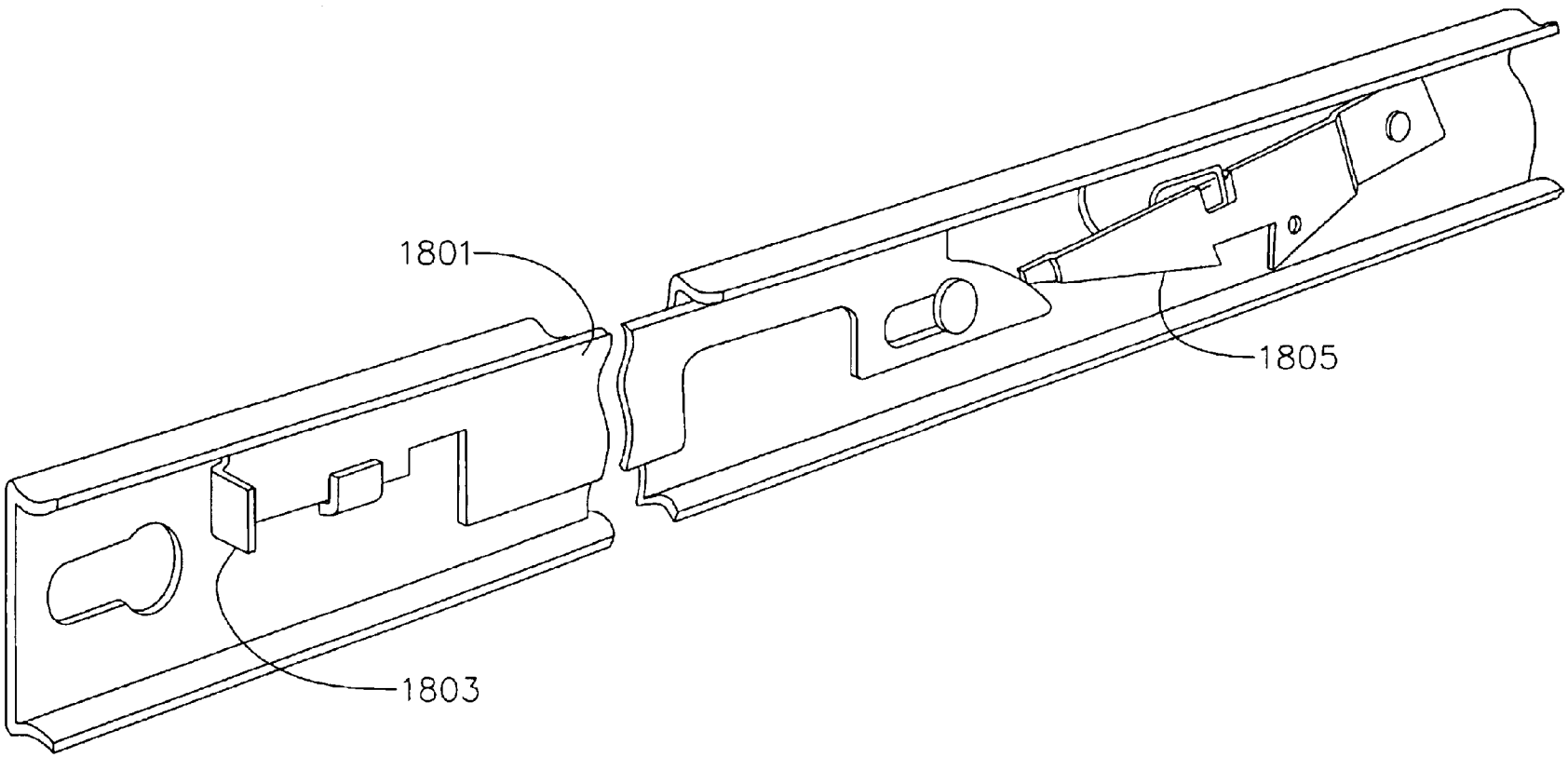
FIG. 18 illustrates a release lever useful in some embodiments of the invention.

FIG. 18 illustrates an alternative release lever which may be used in conjunction with aspects of the invention. The release arm includes a cam 1801 extending away from a locking lever, with contact of the cam and release lever 1805 biasing the release lever. The cam includes an extending tab 1803 on a distal end to allow for movement of the release lever.

Figure 19:
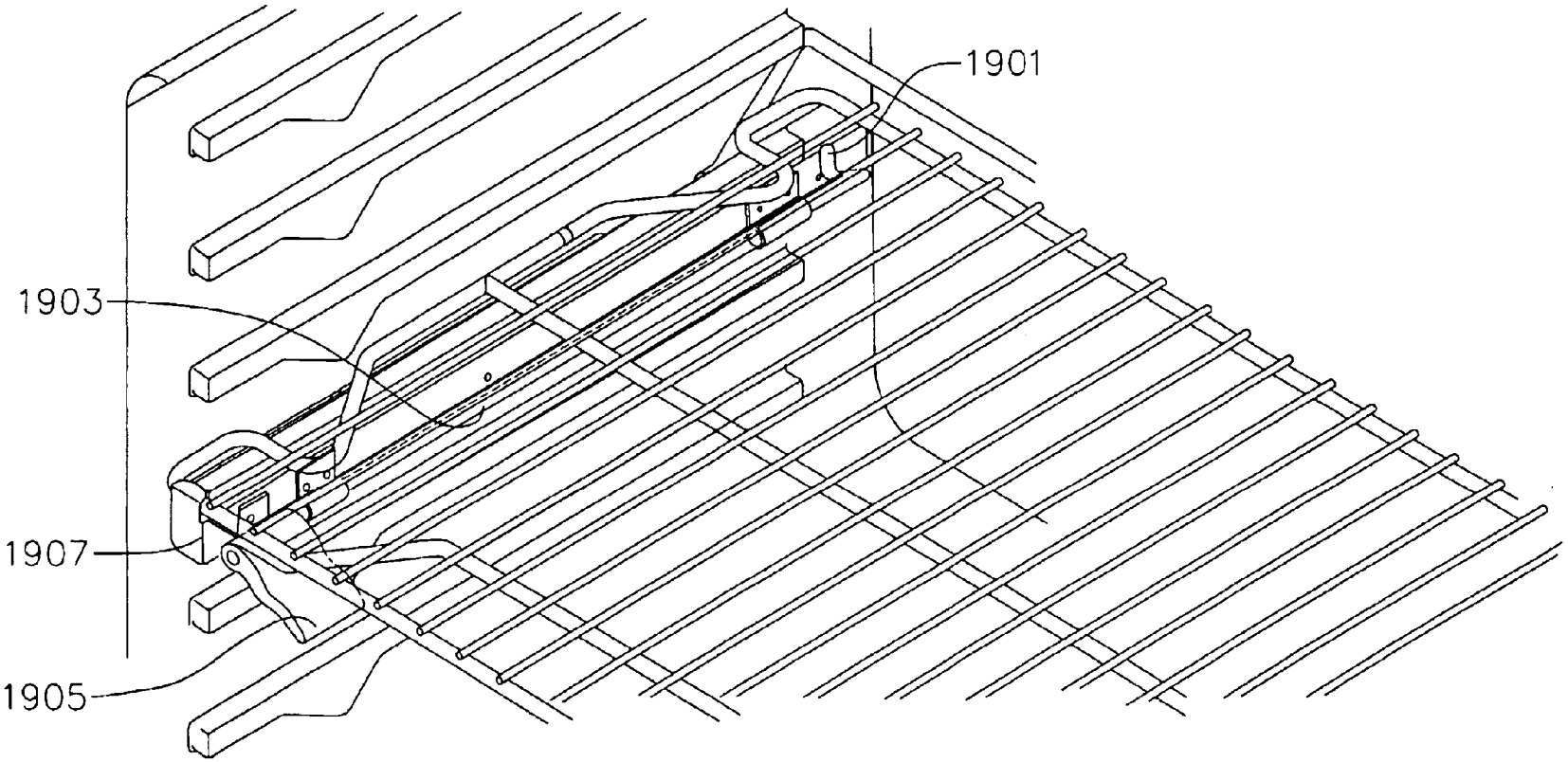
FIG. 19 illustrates a lever release latch mechanism useful, for example, in the embodiment of FIG. 3.

FIG. 19 illustrates a further locking mechanism in accordance with aspects of the invention. The locking mechanism includes an arm 1901. The arm is at one end of a cylindrical shaft 1903. The other end of the shaft includes a lever. Movement of the lever results in rotation of the shaft, and therefore movement of the arm. The cylinder is mounted against the side of the L-bracket accessory 1907, with the lever towards the front of the L-bracket, and therefore the front of the oven, and the arm towards the rear. With the lever in a first position the arm extends underneath the L-bracket and abuts the rear end of a drawer slide (not shown) to which the L-bracket is mounted. Movement of the arm in a forward direction, and therefore of the L-bracket and associated rack, is prevented by contact between the arm and the rear of the drawer slide.

Figure 20:
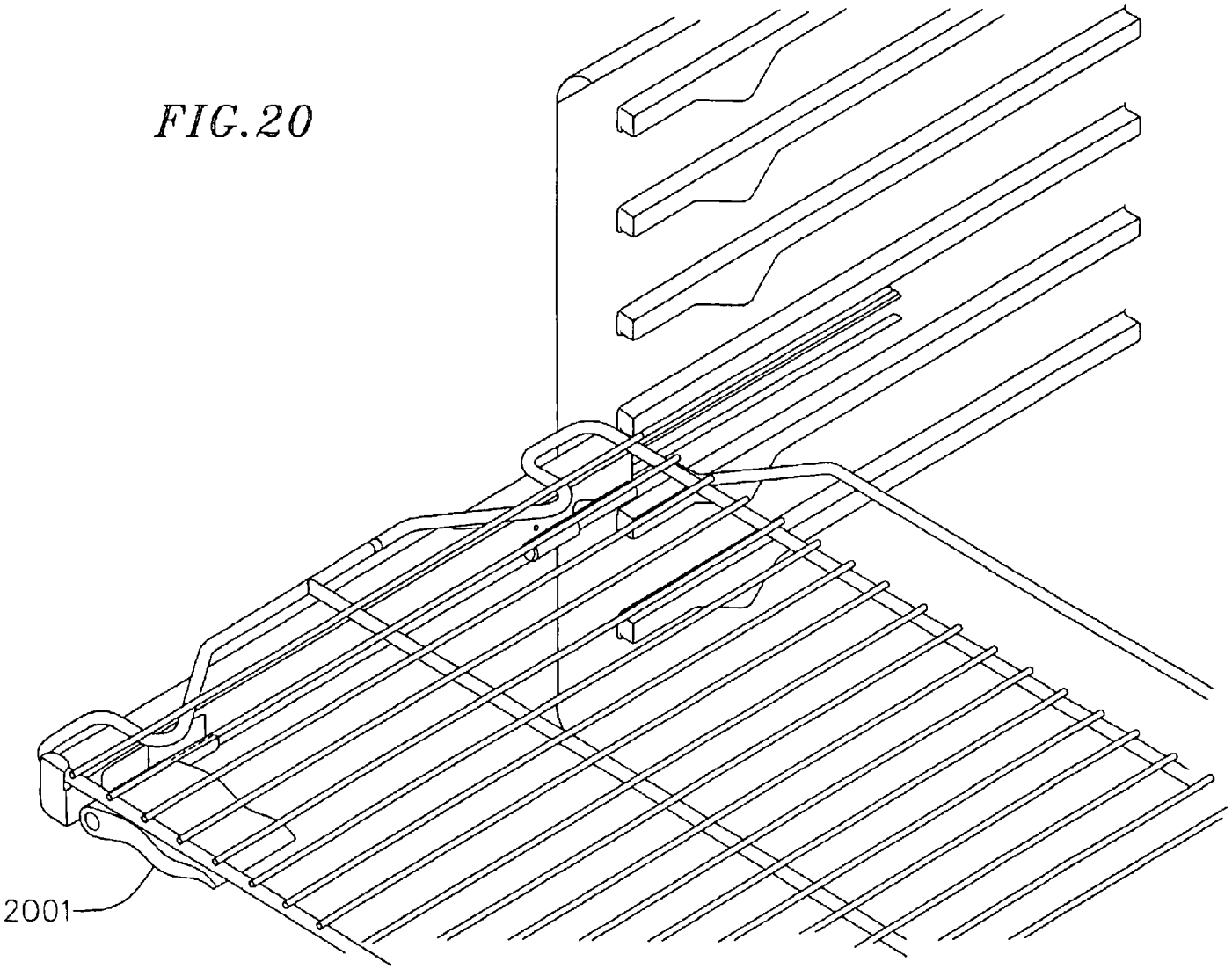
FIG. 20 illustrates the lever release latch mechanism of FIG. 19 in the open position.

FIG. 20 shows the latch and assembly of FIG. 19, with the lever 2001 positioned so that the arm no longer abuts the rear of the drawer slide. In such a position the drawer slide may be extended, with the rack extending from the oven. Once the rack has been extended from the oven, as shown in FIG. 20, the lever may be repositioned so that the arm again abuts a portion of the drawer slide, thereby locking the rack in an extended position. Thus, the lever arm and system of FIGS. 19 and 20 are right for a convenient locking mechanism for the assembly.

Figure 21:
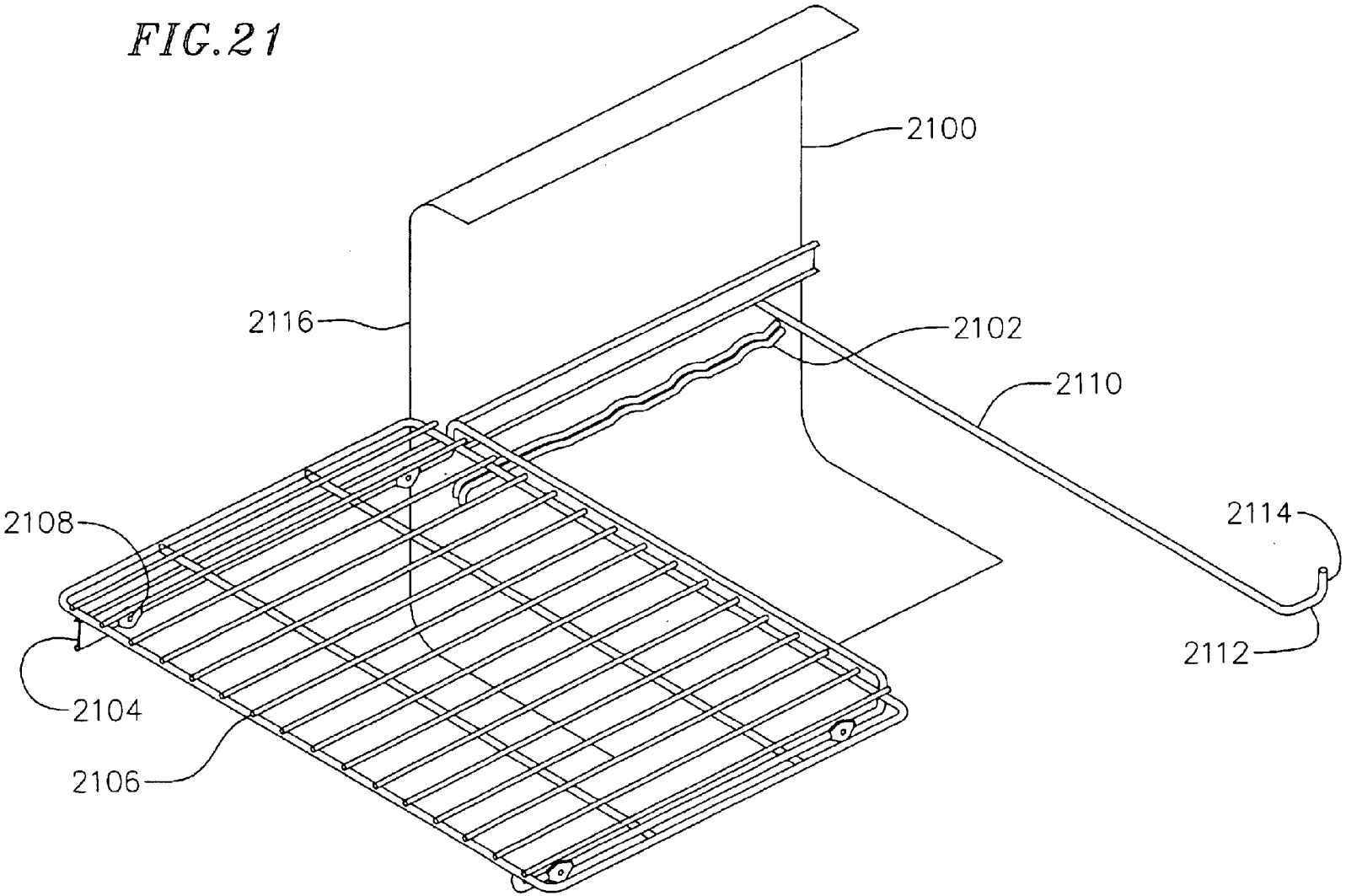
FIG. 21 illustrates a view of an alternative slide mount system used in an oven.

FIG. 21 illustrates a cut-away view of a further oven including an extendible rack in accordance with aspects of the invention. The oven includes an oven cavity with a ledge 2102 on the sidewall of the oven cavity. As in other embodiments, slides 2104 are coupled to the ledge. The slides support an oven rack 2106 attached to the slides by way of a screw 2108 rivet or a weld, with the rack extendable from the oven cavity using the slides. A rear support bar 2110 is attached, through welding for example, to the web of the rear of the slide.

The rear support bar is symmetrical, with aspects of the bar away from the illustrated slide shown in FIG. 21 to allow for increased ease of understanding. As shown in FIG. 21, the bar includes a horizontal portion 2112 extending towards the rear of the oven cavity. The horizontal portion is adapted to rest underneath the ledge, preventing the rear bar from moving upwards when the rack is extended. An end of the bar 2114 is bent upwards. The end of the bar is adapted to wrap around the back of the ledge and restrict forward movement of the bar. The end of the bar is also welded to the web of the slide member. The end of the bar therefore prevents undesired extraction of the slide from the oven cavity. By tilting upward the forward edge of the slide, however, the end of the bar may be displaced so as to clear the ledge and allow for removal of the slide from the oven cavity.

The slide is supported on the ledge by a forward bar 2116. The forward bar is welded to a portion of the outer slide member web. The bar is welded in horizontal position along the length of the web. The bar includes a downward facing leading edge, which is adapted to contact a front of the ledge of the oven cavity when the bar is resting on the ledge. The bar extends approximately halfway along the length of the slide member.

Figure 22:
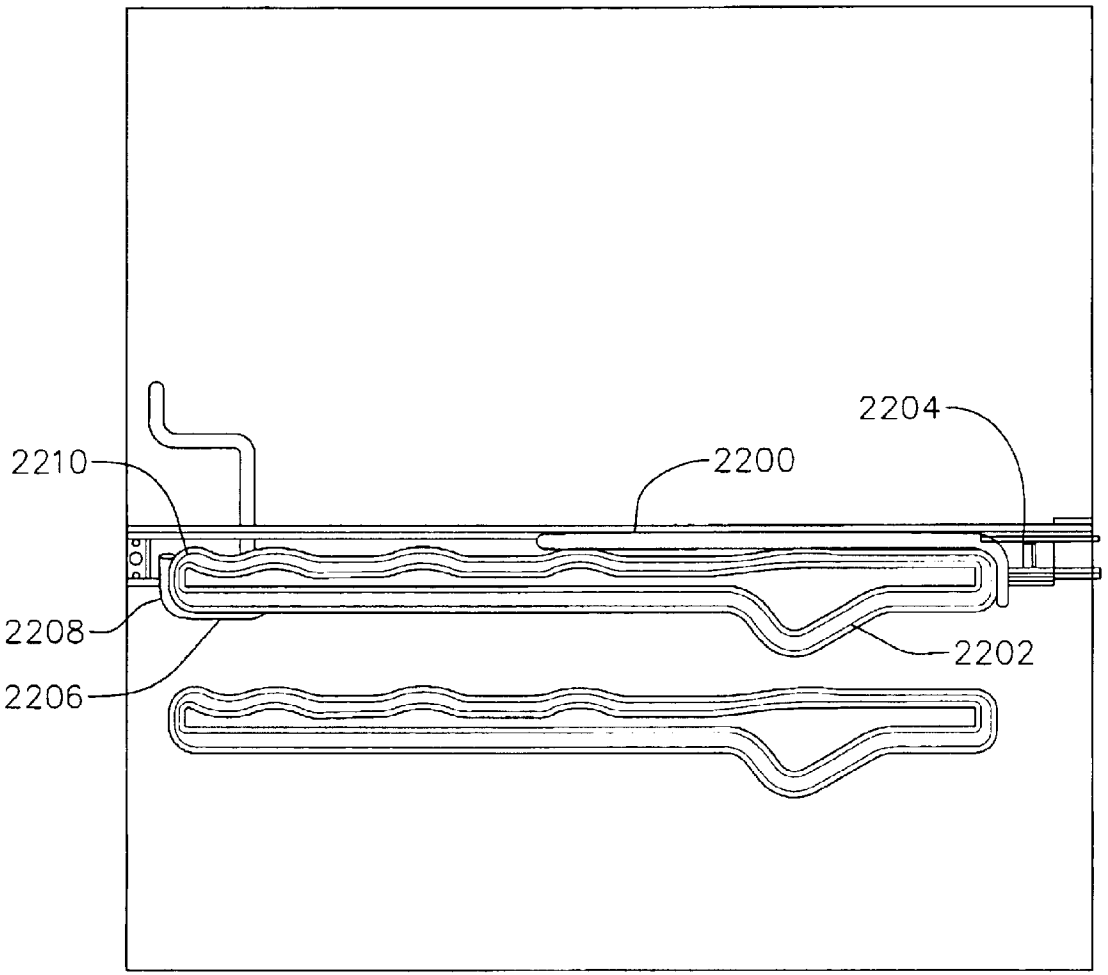
FIG. 22 illustrates a further view of mounting rods used to mount a slide in an oven cavity.

The interaction between the rear bar and the forward bar and the ledge of the oven cavity may be seen more clearly in FIG. 22. FIG. 22, a side view of the oven cavity is provided with the oven walls illustrated as translucent. As may be seen in FIG. 22, a forward bar 2200 rests on the top of a ledge 2202. The forward bar is attached to the web of the slide member 2204. The forward bar extends substantially along the length of the slide member and provides vertical support for the slide. A leading edge of the forward bar wraps around the front of the oven ledge, preventing further rear movement of the slide.

A rear bar contains a horizontal portion 2206. The horizontal portion rests underneath the oven ledge and is adapted to contact the rear of the oven ledge 2210. An upwardly bent portion 2208 wraps around the rear of the oven ledge. The upwardly bent portion prevents the slide member from being pulled out of the oven when the slide is extended. However, if the front of the slide is tilted upward, the upwardly bent portion is able to pass underneath the ledge and allow for removal of the slide.

The connecting bar which connects the opposing sides of the portions adapted to contact the oven ledges provides for increased lateral support for the structure as a whole. As the rear bar is substantially the width of the oven cavity, the rear of the slide and the portions of the bar which interacts with the ledge are maintained in position along the ledge, and do not flex inwards away from the ledge.

Figure 23:
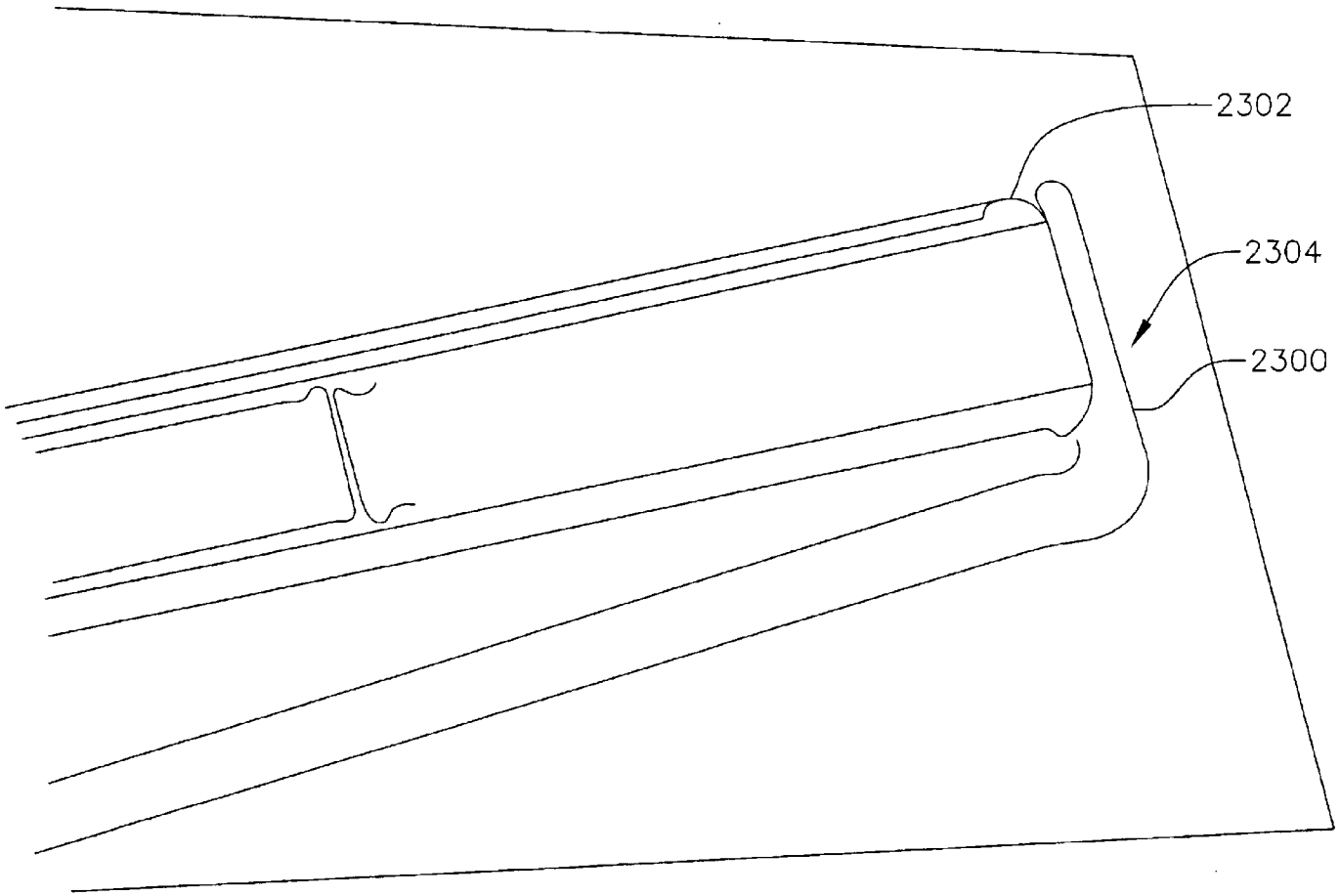
FIG. 23 illustrates a further view of the mounting bars of FIG. 22.

FIG. 23 shows further detail of the portion of the rear bar and the slide. As can be seen in FIG. 23, an upwardly bent portion of the rear bar 2300 is mounted to a web of a slide member 2302. A portion of the bar also is in contact with a rear edge of an oven ledge 2304.

Figure 24:
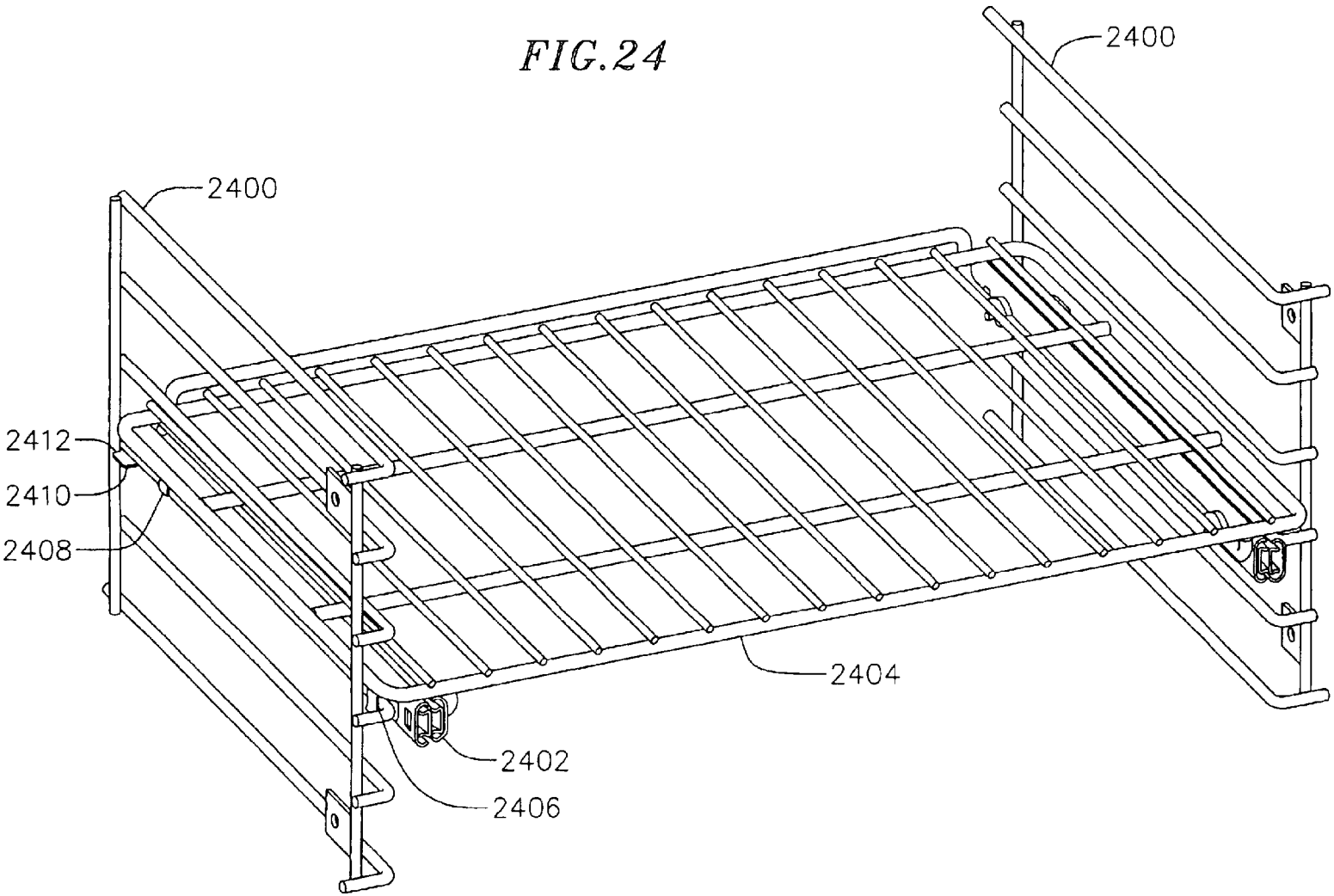
FIG. 24 illustrates an oven rack mounted to a wire frame using slides.

FIG. 24 illustrates an alternative extendable oven rack coupled to a wire frame. Some ovens use wire frames within the oven cavity to support racks and other similar fixtures. The wire frames may be used for a variety of reasons, including maintenance of a smooth or somewhat smooth cavity wall for airflow purposes and the like. As illustrated in FIG. 24, wire frames 2400 support opposing edges of an oven rack 2404. The wire frames include opposing parallel vertical posts coupled by cross-bars. The wire frames are adapted to be mounted to opposing side walls of an oven cavity, with the oven rack bridging the distance between the two wire frames.

Slides 2402 couple the oven rack to the wire frames. As illustrated, the slides are a side-by-side slide. The oven rack may, for example, have opposing sides each welded to one of the slide members of the slides. The slides are supported by a cross-bar of the wire frame. As illustrated in FIG. 24, a forward hook 2406 couples each slide to a cross-bar near a forward portion of the wire frame, and a rear hook 2408 couples each slide to a rear portion of the cross-bar of the wire frame. To provide further fixation of the slide with respect to the cross-bar, a ledge 2410 extends from the slide underneath the cross-bar. In one embodiment, and as illustrated in FIG. 24, the ledge is approximate a rear post of wire frame and includes a cut-out portion 2412 adapted to receive a vertical post of the wire frame. The hooks, therefore, support the slide and the oven rack on the cross-bar, with the ledge providing further support. In particular, as the slides and oven rack are extended, the weight of the extended slides and oven rack could cause the slides and rack to tilt forward. The ledge, however, serves to prevent upward motion of the rear of the rack and slide structure, thereby safely maintaining the rack in position.

Figure 25:
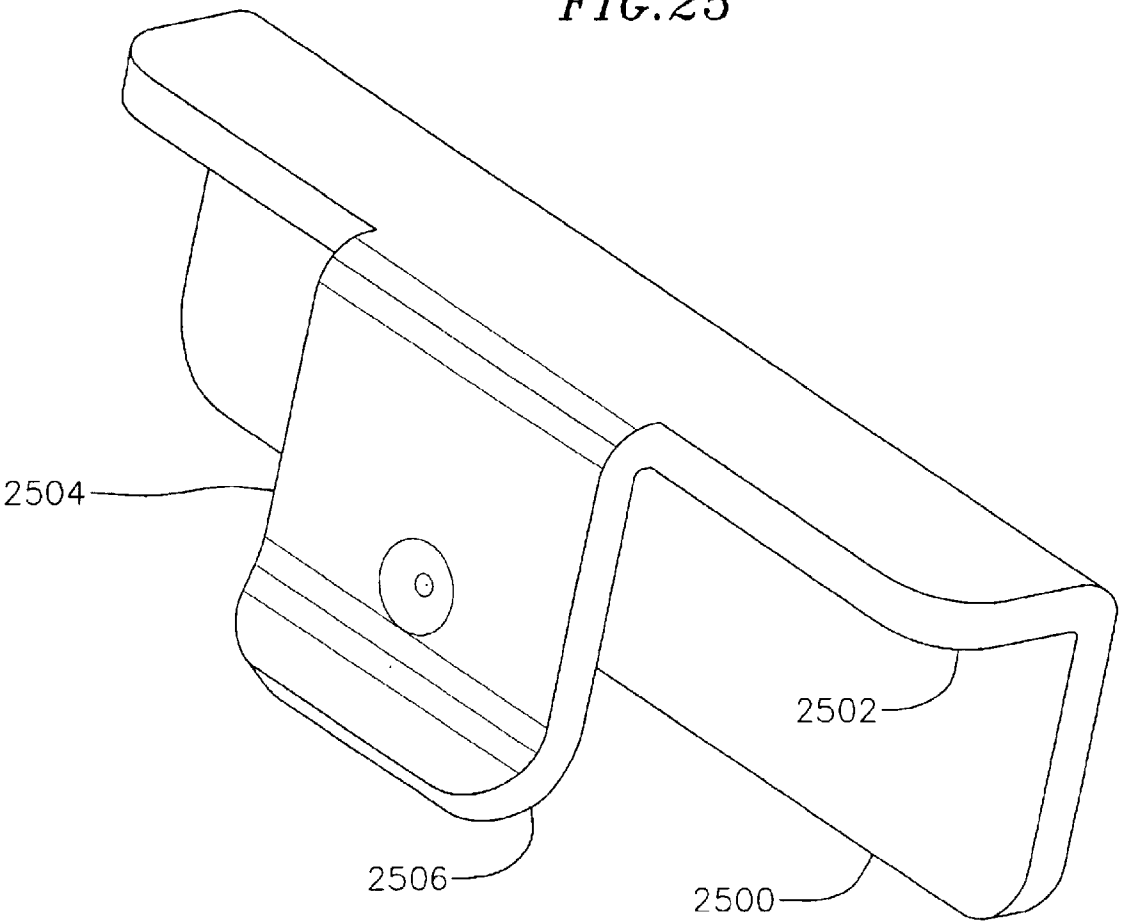
FIG. 25 illustrates a clip used to mount a slide to a wire rack.

FIG. 25 illustrates a view of the forward hook of FIG. 24. As illustrated, the hook includes a planar portion 2500 adapted to be welded or otherwise affixed to the web of the slide member. A top portion 2502 extends from the planar portion, with the top portion and the planar portion forming the shape of an L-bracket. A front 2504 of the hook is formed of a tab extending downward from the top portion with the front of the hook largely parallel to the planar section. In some embodiments, the front of the hook includes a outwardly bent leading edge 2506 curved away from the planar portion, providing for easier insertion of a cross-beam into the hook.

Figure 26:
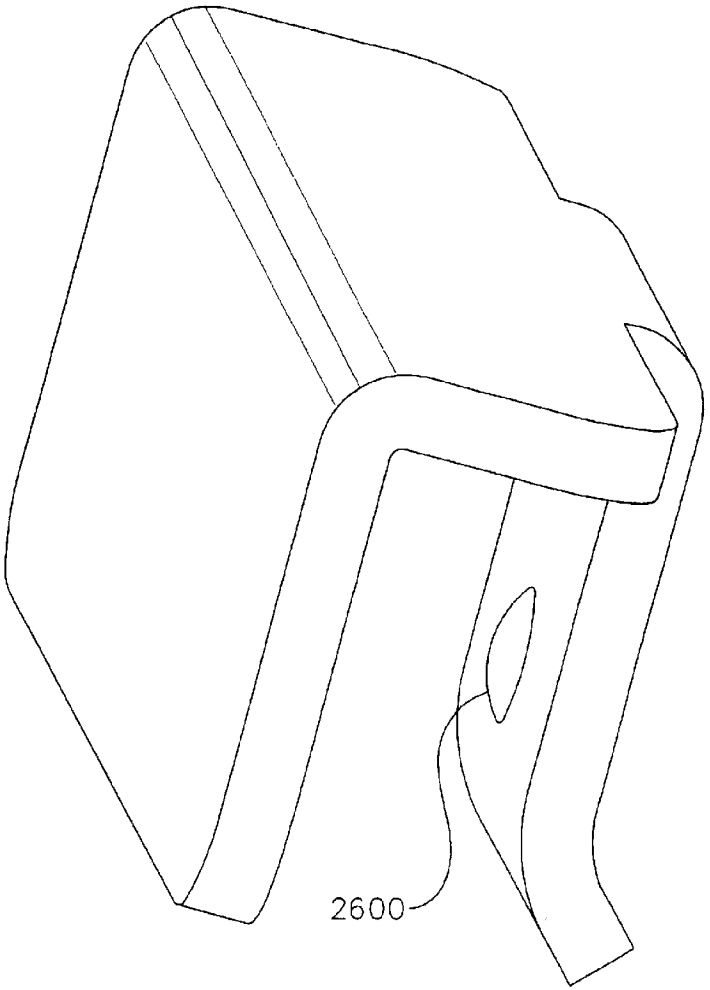
FIG. 26 illustrates a further view of the clip of FIG. 25.

FIG. 26 illustrates a further view of the hook of FIG. 25. As illustrated in FIG. 26, the inner portion of the front of the hook is illustrated, including a protrusion 2600 extending into the space between the planar portion and the front of the hook. The protrusion, which may be formed by embossing the front of the hook, serves to act as a frictional interface or detent to maintain a cross-bar within the hook and provide a snapping insertion feature.

Figure 27:
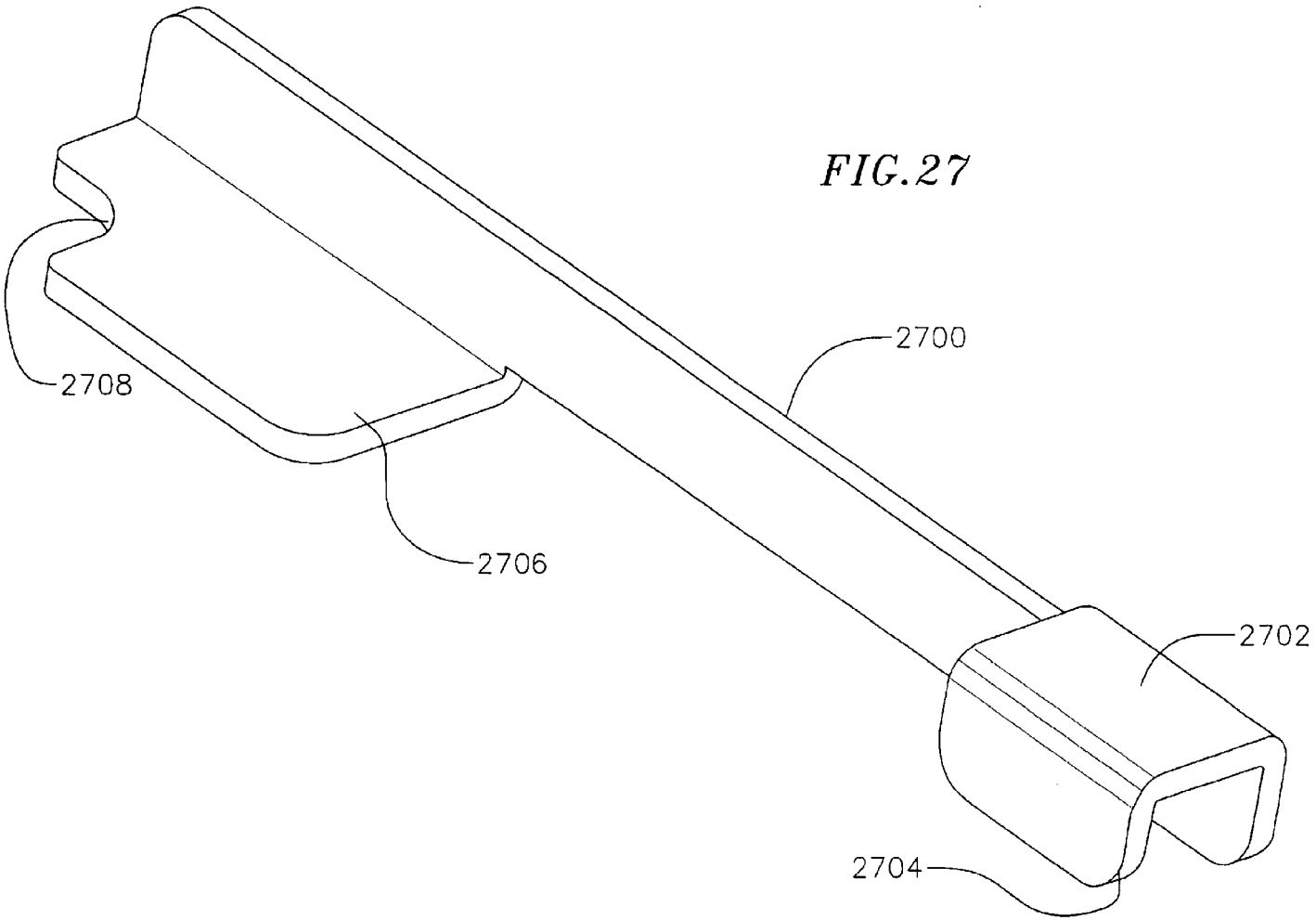
FIG. 27 illustrates a further clip used to mount a slide to a wire rack.

FIG. 27 illustrates a view of the rear hook of FIG. 24. As illustrated, the hook includes a planar portion 2700 adapted to be welded or otherwise affixed to the web of the slide member. The planar portion as illustrated in FIG. 24 is a largely rectangular elongate plate. A top portion 2702 extends from a portion of the planar portion, with the top portion and the planar portion forming a shape of an L bracket. As illustrated in FIG. 27, the top portion is approximate a forward edge of the planar portion, which is elongate in shape. Accordingly, the L bracket formed by the top portion and the planar portion is only towards the front of the planar portion. A forward edge 2704 hangs from the top portion, with the forward edge substantially parallel to the planar portion. The forward edge, top portion, and planar portion forming a U shaped channel. The U shaped channel is adapted to receive a cross-bar of a wire frame.

A ledge 2706 extends from the rear of the planar portion. The ledge extends in the same direction as the top portion, and with the top portion being viewed as extending from an upper front edge of the planar portion, the ledge extends from the lower rear of the planar portion. A forward edge of the ledge includes a cut-out 2708. The cut-out is adapted to receive a vertical post of the wire frame.

Figure 28:
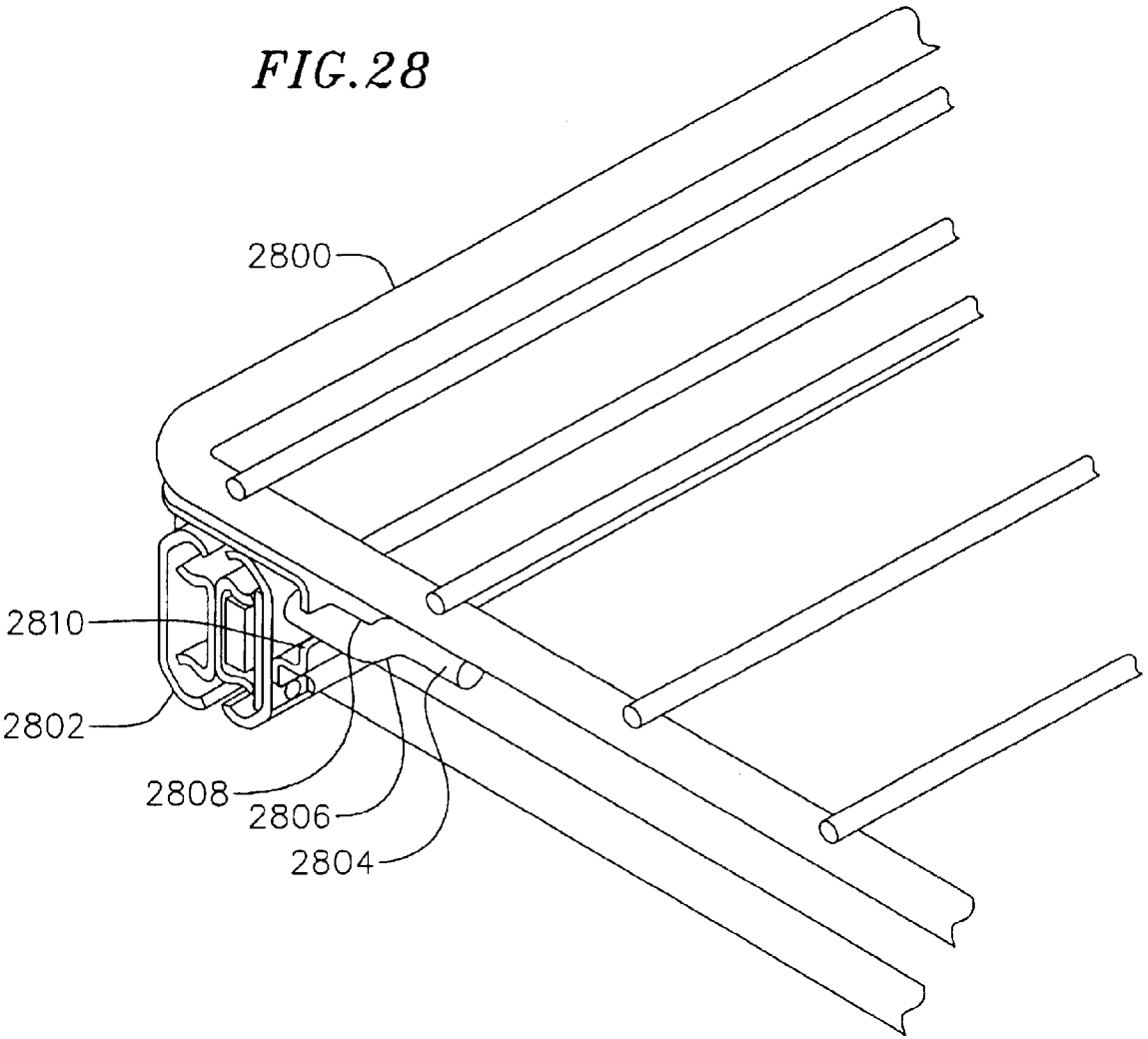
FIG. 28 illustrates a further system for connecting an oven rack to a slide assembly.

FIG. 28 illustrates a view of mechanism for coupling an oven rack to a slide member. As illustrated in FIG. 28, an oven rack 2800 is coupled to a side-by-side slide 2802. A forward bar of the oven rack has a mounting S-bar 2806 coupled to it. The mounting S-bar includes a mounting portion 2804 welded to the bottom of the oven rack. An offset bar 2808 is coupled to the mounting portion through a bend. The offset portion is substantially parallel to a forward edge of the oven rack. S-bars are mounted to the forward bar approximate slide members of both slides. Similarly, S-bars are also mounted to a rear bar of the oven rack.

The offset portion is sized to fit in a receiver 2810 coupled to the slide member. The receiver, as illustrated in FIG. 28 is substantially a U shaped cut-out or receiver, in a bracket attached to a web of the slide member. The bracket extends substantially along the length of the slide member, with a corresponding U shaped cut-out, or receiver, a the rear of the bracket. The cut-out at the rear of the bracket faces in the opposing direction, namely rearwardly, compared to the cut-out at the front of the bracket.

Figure 29:
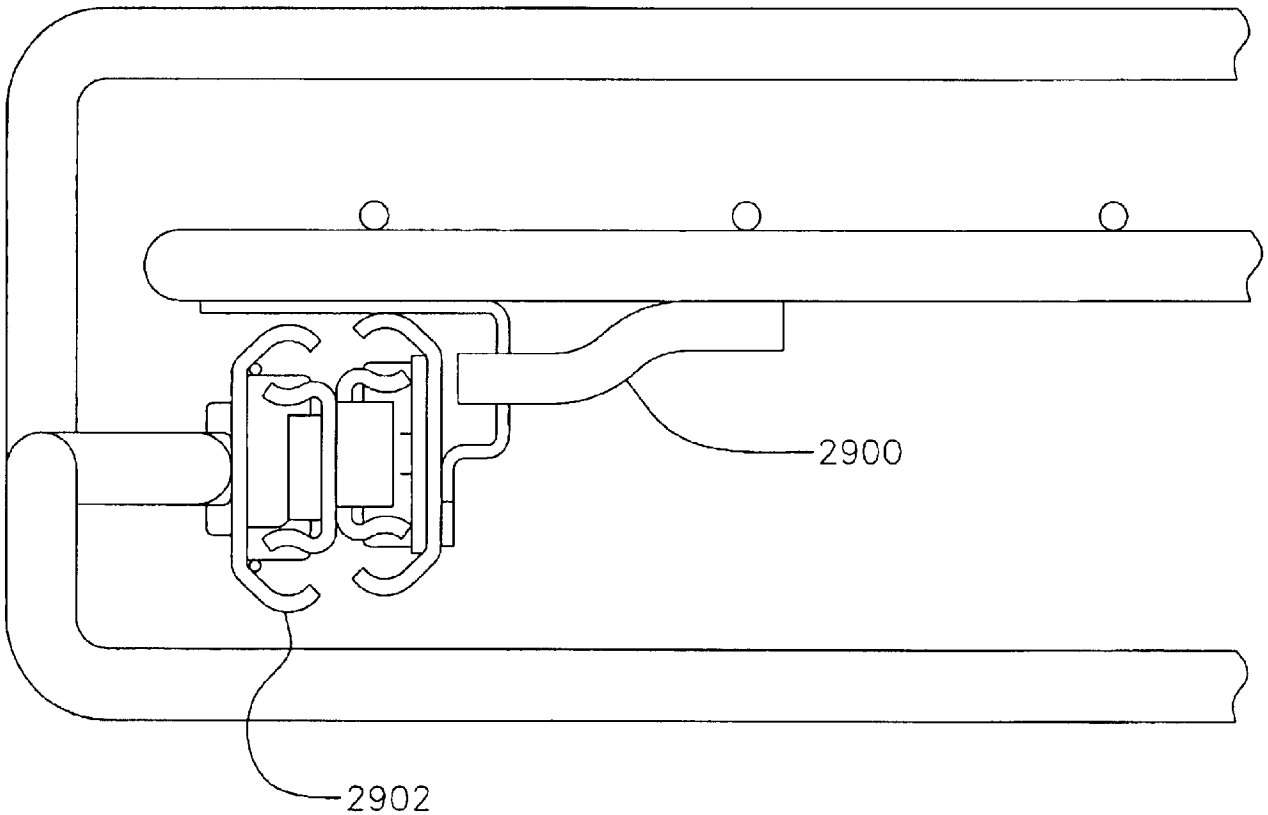
FIG. 29 illustrates a front view of the system of FIG. 28.

FIG. 29 illustrates a further view of the mechanism of FIG. 28. As illustrated in FIG. 29, an S-bar is adapted to be coupled to a side by side slide 2902 by way of a receiving bracket 2904. The receiving bracket is somewhat U shaped, with a mounting flange extending from the U shape. The mounting flange is adapted to be welded or otherwise attached to the web of the slide member. The U shape includes a notch or receiver, on one side adapted to receive the offset bar.

Accordingly, the present invention provides a rack assembly for an oven and an oven with a rack assembly. Although the invention has been described in certain embodiments, the scope of the invention should be measured by the claims and their equivalents supported by this description.

What is claimed is:

1. An extendable oven rack assembly comprising:

an oven rack adapted for positioning in an oven cavity;

two full extension slides, one each coupled to opposing margins of the oven rack, opposing wire frames positioned approximate opposing margins of the oven rack, the wire including vertically spaced cross-bars;

a first bracket coupled to each slide, the first bracket including a channel receiving a single cross-bar of the vertically spaced cross-bars of the wire frame; and a second bracket coupled to each slide, the second bracket including a channel and a ledge, the channel receiving the single bar and the ledge extending under the single cross-bar.

2. The extendable oven rack assembly of claim 1 wherein the slides provide extension of the oven rack from a position entirely within the oven cavity to a position outside the oven cavity.

3. The extendable oven rack assembly of claim 2 wherein the ledge includes a notch configured to receive a vertical wire of the wire frames.

4. The extendable oven rack assembly of claim 1 further comprising means for locking the full extension slides in a pre-defined position.

5. An oven comprising:

an oven enclosure including sidewalls;

an oven rack normally within the oven enclosure;

full extension slides each with a first slide member coupled to the oven rack along opposing margins of the oven rack;

opposing wire frames positioned approximate the side walls of the oven, the wire frames containing vertically spaced cross-bars;

a first bracket coupled to each slide, the first bracket including a channel receiving a single cross-bar of the vertically spaced cross-bars of the wire frame; and a second bracket coupled to each slide, the second bracket including a channel and a ledge, the channel receiving the single cross-bar and the ledge extending under the single cross-bar.

6. The oven of claim 5 further comprising means for locking the full extension slides in a pre-defined position.

7. A drawer slide assembly with mounting brackets adapted to mount to a cross-bar, comprising:

a first slide member;

a second slide member extendably coupled to the first slide member;

a first bracket coupled to the first slide member, the first bracket including a channel configured to receive a cross-bar to provide support for the drawer slide assembly in a first direction;

a second bracket coupled to the first slide member, the second bracket including a channel and a ledge, the channel configured to receive the cross-bar to provide support for the drawer slide assembly in the first direction, and the ledge configured to contact the cross-bar when the cross-bar is received by the channel and to prevent motion of the drawer slide assembly about the ledge in a second direction opposite the first direction.

8. The drawer slide assembly with mounting brackets of claim 7 wherein the first slide member has a front and a rear, and the first bracket is mounted approximate the front and the second bracket is mounted approximate the rear.

9. The drawer slide assembly with mounting brackets of claim 8 wherein the ledge includes a notch configured to receive a bar substantially perpendicular to the cross-bar.

10. An oven rack assembly comprising:

an oven rack;

full extension slides comprising a first slide member and a second slide member extendably coupled by an intermediate slide member, each first slide member coupled to the oven rack along opposing margins of the oven rack;

a rack frame coupled to the second slide member of each of the full extension slides;

wherein the rack frame includes an extending tab, the extending tab including an extending portion forming a leaf spring configured to press against side walls of the oven cavity; and further comprising a plastic sleeve fitted onto the extending portion.

11. The oven rack assembly of claim 10 wherein sides of the rack frame are configured to rest on ledges on side walls of an oven cavity.

12. The oven rack assembly of claim 11 wherein the sides of the rack frame are connected by an elevated rear bar.

* * * * *